US009930982B2

(12) United States Patent
Matsui

(10) Patent No.: US 9,930,982 B2
(45) Date of Patent: Apr. 3, 2018

(54) BEVERAGE CONTAINER HOUSINGS

(71) Applicant: MISAINE TRADE, INC., Torrance, CA (US)

(72) Inventor: Hirotaka Matsui, Lomita, CA (US)

(73) Assignee: MISAINE TRADE, INC., Torrance, CA (US)

( * ) Notice: Subject to any disclaimer, the term of this patent is extended or adjusted under 35 U.S.C. 154(b) by 155 days.

(21) Appl. No.: 14/711,277

(22) Filed: May 13, 2015

(65) Prior Publication Data

US 2016/0331167 A1 Nov. 17, 2016

(51) Int. Cl.
*B65D 25/00* (2006.01)
*A47G 23/02* (2006.01)

(52) U.S. Cl.
CPC ..... *A47G 23/0233* (2013.01)

(58) Field of Classification Search
CPC ..... A47G 23/0233; A47G 23/0208; A47J 41/026; A47J 41/00; B65D 81/3876; B65D 81/3881
USPC ..... 220/737–740, 592.01, 592.17, 592.18, 220/592.24, 592.2, 592.23, 23.91, 23.89, 220/23.88, 23.87, 23.86, 319, 4.06, 8, 220/4.27; 229/403, 404; 206/217, 218, 206/545, 546, 541, 459.5, 457
See application file for complete search history.

(56) References Cited

U.S. PATENT DOCUMENTS

D4,260 S 7/1870 Ice
2,051,446 A 8/1936 Ice
2,276,678 A 3/1942 Wheeler
2,368,273 A 1/1945 Tibbetts
2,707,588 A 5/1955 Amberg
2,863,585 A 12/1958 Meshberg
3,205,677 A 9/1965 Stoner
3,766,975 A 10/1973 Todd
4,163,374 A 8/1979 Moore
D273,651 S 5/1984 Emrick
4,509,656 A * 4/1985 Rosler ..... B65D 21/086 220/8
4,582,197 A 4/1986 Lin
4,928,412 A * 5/1990 Nishiyama ..... A47G 19/2227 40/324
5,076,463 A 12/1991 McGraw
5,092,485 A 3/1992 Lee
5,275,277 A 1/1994 Gallegos
D364,317 S 11/1995 Humphrey
(Continued)

OTHER PUBLICATIONS

<http://store.starbucks.com/Stainless-Steel-Create-Your-Own-Tumb> May 2013.

(Continued)

*Primary Examiner* — J. Gregory Pickett
*Assistant Examiner* — Rafael Ortiz
(74) *Attorney, Agent, or Firm* — Knobbe, Martens, Olson & Bear, LLP

(57) ABSTRACT

The current disclosure is directed to housings for beverage containers. The housings may be used to protect, insulate, and/or display beverage containers. The housings can include an outer shell and an inner shell that are releasably attached together with a coupling. The outer shell may be transparent. The inner shell may be opaque. A beverage container may be housed between the inner shell and the outer shell.

11 Claims, 24 Drawing Sheets

(56) References Cited

U.S. PATENT DOCUMENTS

| | | | | |
|---|---|---|---|---|
| 5,605,242 | A * | 2/1997 | Hwang | B65D 21/086 220/4.03 |
| D400,397 | S | 11/1998 | Stephan | |
| 5,938,015 | A | 8/1999 | Candy | |
| 6,367,652 | B1 * | 4/2002 | Toida | B65D 25/2811 220/592.16 |
| 6,467,644 | B1 | 10/2002 | Yeh | |
| 6,528,105 | B1 | 3/2003 | Gerhart | |
| 6,562,270 | B1 | 5/2003 | Gannon | |
| D480,919 | S | 10/2003 | Bin | |
| D488,672 | S | 4/2004 | Oas | |
| D553,437 | S | 10/2007 | Bodum | |
| D587,528 | S | 3/2009 | Trombly | |
| 7,631,781 | B2 | 12/2009 | Chen | |
| D618,964 | S | 7/2010 | Eisenhardt | |
| 7,878,365 | B1 * | 2/2011 | Meehan | A47G 19/2227 215/10 |
| D635,399 | S | 4/2011 | Delvecchio | |
| 7,951,057 | B2 | 5/2011 | Robertson | |
| 8,033,412 | B2 | 10/2011 | Mayo | |
| D656,009 | S | 3/2012 | Ortiz | |
| D688,523 | S | 8/2013 | Lees | |
| D693,645 | S | 11/2013 | Keyes | |
| 8,757,421 | B2 | 6/2014 | Yang | |
| 8,789,694 | B2 * | 7/2014 | Roesler | B65D 21/086 206/1.5 |
| 8,815,318 | B2 | 8/2014 | Zoss | |
| D724,386 | S | 3/2015 | Royer | |
| D744,280 | S | 12/2015 | Chiang | |
| D744,780 | S | 12/2015 | Lindsay | |
| D753,491 | S | 4/2016 | Trombetta | |
| D757,497 | S | 5/2016 | Bodum | |
| D772,013 | S | 11/2016 | O'Connor | |
| 2007/0181591 | A1 | 8/2007 | Pierce | |
| 2008/0006643 | A1 | 1/2008 | Ma | |
| 2012/0247998 | A1 * | 10/2012 | Wahl | B65D 1/265 206/459.5 |
| 2013/0134677 | A1 | 5/2013 | McDonnell | |
| 2014/0377413 | A1 | 12/2014 | Liu | |

OTHER PUBLICATIONS

<http://www.orientaltrading.com/web/browser/processProductsCatalo> Mar. 2012.

Office Action dated Jan. 19, 2017 in U.S. Appl. No. 29/526,793, filed May 13, 2015.

* cited by examiner

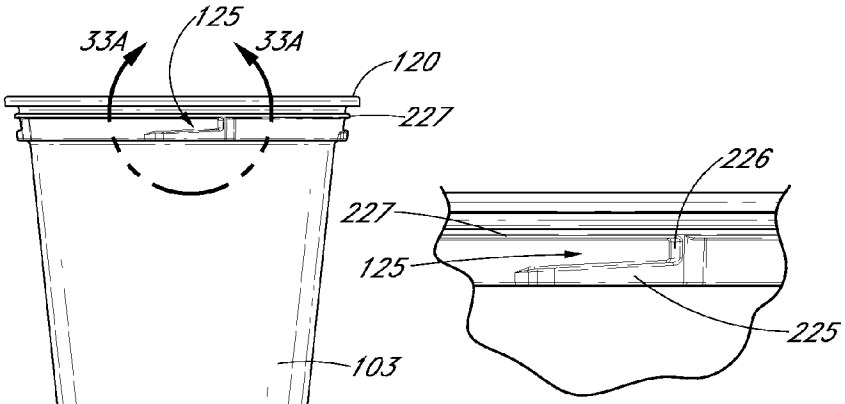
FIG. 33A
FIG. 33
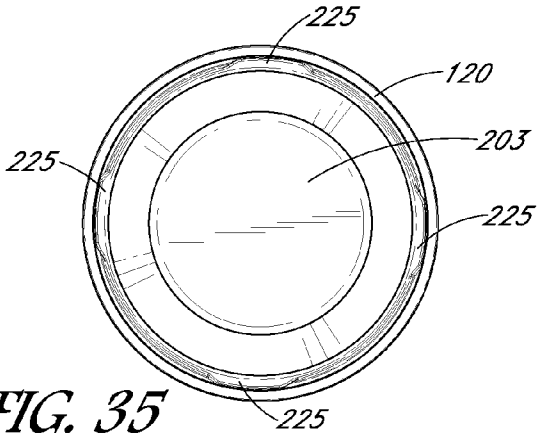
FIG. 35
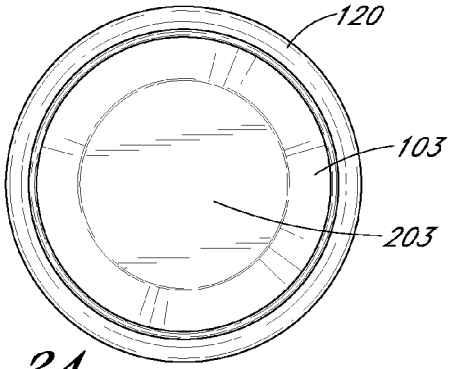
FIG. 34
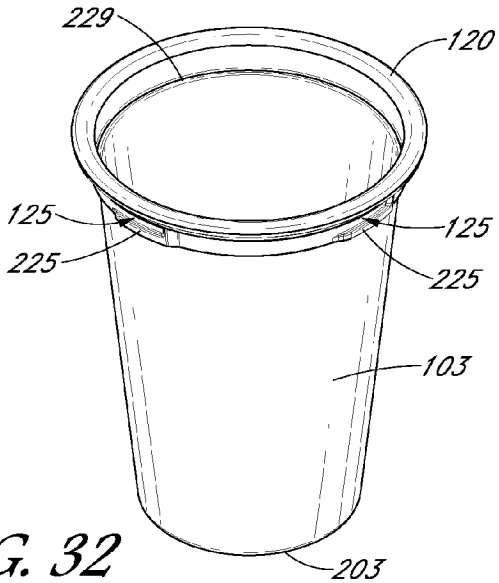
FIG. 32

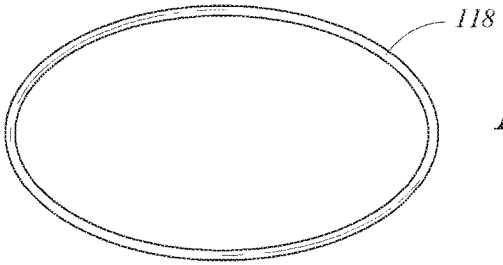
FIG. 54
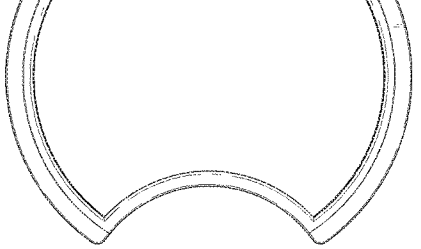
FIG. 55
FIG. 56
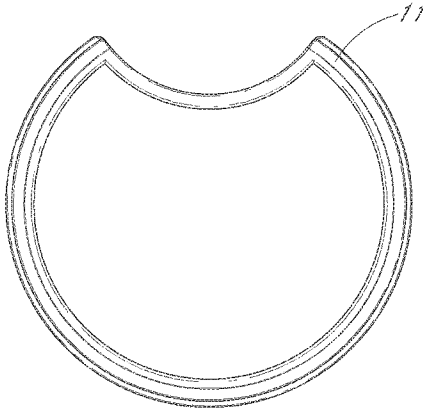
FIG. 57
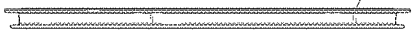
FIG. 58
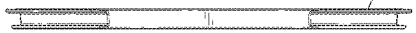
FIG. 59
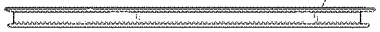
FIG. 60

BEVERAGE CONTAINER HOUSINGS

BACKGROUND

Field

The present disclosure relates generally to beverage containers. More specifically, the present disclosure is directed to housings that can protect, insulate, and display beverage containers.

Description of Related Art

Double-walled containers may aid in keeping hot drinks hot and cold drinks cold. Such containers typically include an inner container and an outer container fixedly separated by an insulating space. The insulated space may be filled with gas to increase the thermal insulation. Disposable beverage containers are typically single walled.

SUMMARY

The devices, systems, and methods disclosed herein have several features, no single one of which is solely responsible for its desirable attributes. Without limiting the scope as expressed by the claims that follow, its more prominent features will now be discussed briefly. After considering this discussion, and particularly after reading the section entitled "Detailed Description of the Preferred Embodiments" one will understand how the features of the present systems, methods, and devices provide several advantages over traditional systems, methods, and devices.

Disposable containers made from paper-based materials have a tendency to decompose due to liquid penetration into the paper material—causing the container to deform, become soggy, and/or leak. Thus, disposable containers made from paper-based materials often cannot be used more than once. This may lead to an increase in waste. Furthermore, disposable containers made from paper-based materials may not insulate their liquid contents for as long as desired. In addition, such containers may not include a lid to prevent spills and further insulate the contents of the container.

Disposable containers made from paper-based materials may be advantageous, however, in that they can be affordably manufactured in a wide variety of styles. For example, disposable containers made from paper-based materials may display custom advertising and/or may be designed for seasonal use or special occasions. Accordingly, the present disclosure provides devices, systems, and methods for, inter alia, increasing the usable life of disposable containers made from paper-based materials. The currently disclosed housings also allow for a beverage container that can be customized and/or personalized in appearance.

In one non-limiting embodiment, a housing comprises a transparent outer shell and an insert shell sized and shaped to fit within the transparent outer shell. When the insert shell is inserted into the transparent outer shell, a space may be formed between the transparent outer shell and the insert shell. The space may be sized and shaped to house a beverage container. The beverage container may comprise a cup. The cup may be a disposable paper cup. A coupling may releasably secure the insert shell to the transparent outer shell. At least a portion of the coupling may be disposed on an exterior facing surface of the insert shell. The coupling may include a protrusion extending away from the exterior facing surface of the insert shell. At least a portion of the coupling may be disposed on an interior facing surface of the transparent outer shell. At least a portion of the coupling may include a protrusion extending away from the interior facing surface of the transparent outer shell. In some aspects, the coupling includes a threaded connection between the transparent outer shell and the insert shell. The threaded connection may be secured and unsecured by rotating the insert shell with respect to the transparent outer shell. The coupling may be configured to prevent the insert shell from moving with respect to the transparent outer shell in at least one direction. The coupling may be opaque. In some aspects, the beverage container includes a removable lid that is couplable with the insert shell. A cup may be disposed within the space between the transparent outer shell and the insert shell. At least a portion of the cup may be secured to at least a portion of the insert shell, the outer shell, and/or the coupling.

In another non-limiting embodiment, a beverage container system may comprise an outer shell having a base and transparent walls extending to a circular rim. A coupling ring having a bottom surface may be attached to a generally circular rim. The coupling may also include a top surface and at least one protrusion extending inwardly toward the base. An inner shell may be sized and shaped for insertion into the outer shell. The inner shell may have a flange configured rest on the top surface of the coupling ring. The inner shell may also include at least one receiving space configured to receive the least one protrusion. A beverage container may be positioned in between the outer shell and the inner shell. A removable lid may be included. The lid may be removably couplable with the inner shell. The inner shell may include an inwardly extending lip. The lip may be configured to support a downward facing surface of the lid. In some aspects, the cup includes a top rim having an outwardly extending flange extending therefrom. The coupling ring may include an inwardly extending lip located below the circular rim. The lip may be configured to support the outwardly extending flange from below. In some aspects, the least one protrusion is positioned into the least one receiving space when the inner shell is rotated with respect to the outer shell. In some aspects, the coupling ring has at least four protrusions extending inwardly toward the base. The at least four protrusions may be spaced substantially equally apart about a circumference of the coupling ring.

These and other features, aspects, and advantages of the invention disclosed herein are described below with reference to the drawings of certain embodiments of the present invention.

BRIEF DESCRIPTION OF THE DRAWINGS

The following is a brief description of each of the drawings. From figure to figure, the same reference numerals have been used to designate the same components of an illustrated embodiment. The drawings disclose illustrative embodiments. They do not set forth all embodiments. Other embodiments may be used in addition to or instead. Conversely, some embodiments may be practiced without all of the details that are disclosed. Moreover, it is to be noted that the figures provided herein are not drawn to any particular proportion or scale, and that many variations can be made to the illustrated embodiments.

FIG. 14 illustrates the inner shell and outer shell in an unlocked configuration.

FIG. 15 illustrates the inner shell and outer shell in an locked configuration.

FIG. 32 is a perspective view of the inner shell of FIG. 2.

FIG. 33 is a side view of the inner shell of FIG. 32.

FIG. 33A is an enlarged view of FIG. 33 taken about the line 30A in FIG. 30.

FIG. 34 is a top view of the inner shell of FIG. 33.

FIG. 35 is a bottom view of the inner shell of FIG. 33.

FIG. 54 is a perspective view of the O-ring of FIG. 41.

FIG. 55 is a perspective view of the lid seal of FIG. 41.

FIG. 56 is a top view of the lid seal of FIG. 55.

FIG. 57 is a bottom view of the lid seal of FIG. 55.

FIG. 58 is a front view of the lid seal of FIG. 55.

FIG. 59 is a side view of the lid seal of FIG. 55.

FIG. 60 is a rear view of the lid seal of FIG. 55.

DETAILED DESCRIPTION OF THE PREFERRED EMBODIMENTS

Figure 1:
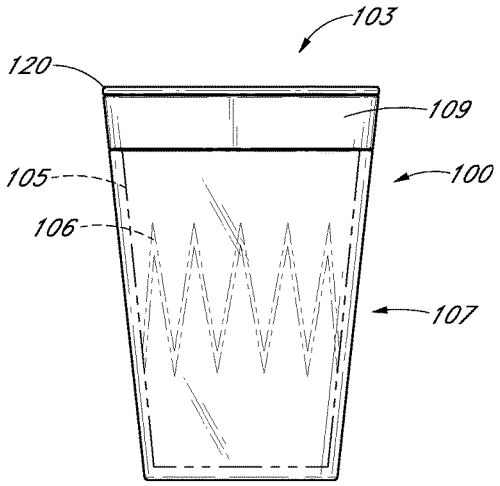
FIG. 1 is side view of a housing for a beverage container according to one embodiment.

The following description and examples illustrate preferred embodiments of the present invention. It does not set forth all embodiments. While following description and examples illustrate preferred embodiments of the present beverage container housings disclosed in the context of use with an exemplary disposable paper cup, the inventions described herein can be implemented in a variety of applications. For example, the housings may be designed to fit with beverage containers of different types, sizes, and shapes. Certain retailers, coffee shops for example, may provide disposable cups in certain fixed sizes and shapes. Thus, the present housing system may be designed and shaped to house these various cups. For example, in some embodiments, the housing is sized and shaped to house an 8 oz. cup. In other embodiments, the housing is sized and shaped to house a 12 oz. cup. In other embodiments, the housing is sized and shaped to house a 16 oz. cup. In other embodiments, the housing is sized and shaped to house a 20 oz. cup. In other embodiments, the housing is sized and shaped to house a 31 oz. cup. In addition, it is also contemplated that the housings described herein may be used without a disposable cup. For example, in some embodiments, the space between the outer and inner shells may be used as a space for removable displays or printed material they may not also function as a disposable cup. In other embodiments, the space between the outer and inner shells is left empty and serves only to help insulate the beverage placed within the housing.

Furthermore, while the preferred embodiments are directed to housings for disposable cups, the housing may be configured to house any beverage container or the like. For example, the housing may be configured to house a pint glass, a cup, a mug, a food storage container, a general storage container, a jar, a ramekin, a bowl, a stein, a tankard, a highball, a tumbler, a wine glass, a flute, a tube, a kettle, a canteen, a water cooler, a bottle, a jug, a demitasse, a pan, a pot, a condiment dispenser, a soap dispenser, a spice holder, a double-walled cup, a pet bowl, a baby bottle, a bottle of spirits, a disposable cup, a bucket, a trough, a biodegradable cup, a reusable cup, a double-walled container, a double-walled ceramic cup, or any other container or the like.

Particular implementations of the subject matter described in this disclosure can be implemented to realize one or more of the following potential advantages. Use of the beverage container housings described herein may increase the usable life of disposable beverage containers. In other words, the housings allow for the disposable beverage containers to be used multiple times, thus reducing waste. The housings may also allow for a beverage placed within the housings to be better insulated than a beverage that was placed in the disposable beverage container alone. In some embodiments, a lid is provided. The lid may further insulate the beverage and prevent spills. The housings may also be adoptable to display various logos, advertising, and displays. Thus, the housings allows for a variety of exterior appearances that may be personalized and/or pleasing to the eye.

Various aspects will now be described with reference to specific forms or embodiments selected for purposes of illustration. It will be appreciated that the spirit and scope of the beverage containers and/or beverage container housing systems disclosed herein are not limited to the selected forms. Brief introductions to some of the features, which are common to the described embodiments, are now described.

To assist in the description of these components of the beverage housing devices and systems, the following coordinate terms are used. A "longitudinal axis" is generally parallel to the elongated walls extending from the base of the beverage containers and/or housings to the upper rim of the beverage containers and/or housings disclosed herein. See, e.g., FIG. 3. A "radial axis" is normal to the longitudinal axis and extends in a radial direction.

In addition, as used herein, "the longitudinal direction" refers to a direction substantially parallel to the longitudinal axis and "the radial direction" refers to a direction substantially parallel to the radial axis. The term "axial" may be used herein and is synonymous with the term "longitudinal" as used herein. The terms "upper," "lower," "top," "bottom," "underside," "upperside," "interior," "exterior," "upward," "downward," "inward, "outward," and the like, which also are used to describe the various structures disclosed herein, are used in reference to the illustrated orientation of the embodiment.

Figure 2:
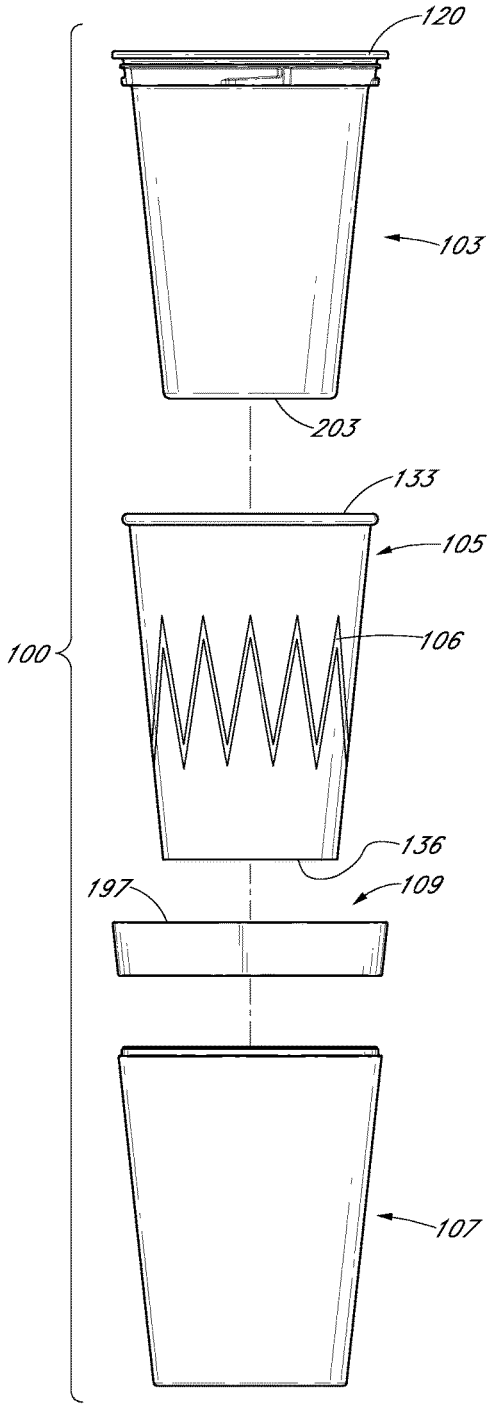
FIG. 2 is an exploded side view of the housing of FIG. 1. From to top to bottom, an inner shell, a beverage container, a coupling, and an outer shell are shown.

FIG. 1 illustrates a side view of beverage container housing system 100 according to one embodiment. FIG. 2 is an exploded side view of FIG. 1. As illustrated, the system 100 includes an outer shell 107, an inner shell 103, and a coupling ring or coupling 109. A beverage container such as a disposable cup 105 may be disposed between the outer shell 107 and the inner shell 103. The outer shell 107, inner shell 103, coupling 109, and disposable cup 105 may be made of one or more materials. Suitable materials include, but are not limited to, biodegradable materials, paper-based materials, ceramics, polymers, plastics, metals, carbon fibers, composite materials, rubbers, organic materials, and/or glass.

The disposable cup 105 may include a graphic design 106. In other embodiments, a banner or a substantially cylindrically insert may be placed between the outer shell and the inner shell in addition to or instead of a cup. As shown in FIG. 1, the outer shell 107 is configured such that the graphic design 106 is visible when the disposable cup 105 is disposed between the outer shell 107 and the inner shell or insert shell 103. In other words, the outer shell 107 is configured such that light may pass through the outer shell 107. In some embodiments, the outer shell 107 is only semi-transparent or translucent. That is to say, the outer shell may be about 100%, 90%, 80%, 70%, 60%, 50%, 40%, 30%, 20%, or 10% transparent. In some embodiments, at least a portion of the outer shell 107 is not transparent.

The outer shell 107 is sized and shaped to receive the disposable cup 105. That is to say, the outer shell 107 has a larger internal volume than the disposable cup 105. The inner shell 103 is sized and shaped for insertion into disposable cup 105. Thus, the inner shell 103 has a smaller internal volume than the disposable cup 105. In general the internal volume of the inner shell is intended to be substantially the same as the internal volume of the cup 105. In this way, the inner shell 103 may be configured to hold substantially the same beverage volume as the disposal cup 105. Thus, in use, a beverage held in disposable cup 105 may be poured into the internal volume of the inner shell 103 without overflow of the beverage from the inner shell 103. In general, the outer shell 107 and the inner shell 103 are sized and shaped such that the housing system 100 does not substantially enlarge the overall size of the disposable cup 105. Thus, in some embodiments the space between the outer shell 107 and the inner shell 103 when the inner shell 103 is inserted into the outer shell 107 is minimized and the housing system 100 is thus configured to snugly receive a disposal cup 105. In other embodiments, excess space is provided.

Continuing with FIGS. 1-2 the coupling 109 may removably secure the outer shell 107 to the inner shell 103. Although FIG. 2 shows a coupling ring 109 that is a separate piece from the outer shell 107, in some embodiments, the outer shell 107 and the coupling 109 are a unitary piece. In some embodiments, the outer shell 107 may include a coupling 109 disposed on at least a portion of the interior facing surfaces of the outer shell 107. In other embodiments the coupling 109 is fixedly attached to the outer shell 107. As shown in FIG. 1, for example, the coupling 109 is opaque or not transparent. In in this way the internal coupling mechanism is hidden from view. In other embodiments, at least a portion of the coupling 109 is translucent or transparent.

As also shown in FIGS. 1-2, the inner shell 103 may include a rim that includes an outcropping or flange 120. The flange 120 may be configured to contact the top surface 197 of the coupling 109 when the inner shell 103 is inserted into the outer shell 107 and/or the coupling 109. Thus, the top surfaces of the coupling 109 may support the flange 120 from below. In some embodiments, the inner shell 103 is shaped such that the flange 120 suspends the base 203 of the inner shell 103 above the base 136 of the disposable cup 105. In other embodiments the inner shell 103 is shaped such that the base 203 of the inner shell 103 contacts at least a portion of the base 136 of the cup 105. In some embodiments, the flange is sized and shaped to extend over the inner shell 103. In this way, a gripping surface may be provided. The inner shell 103 may be opaque or not transparent. In other embodiments, the inner shell 103 is at least partially transparent.

Figure 3:
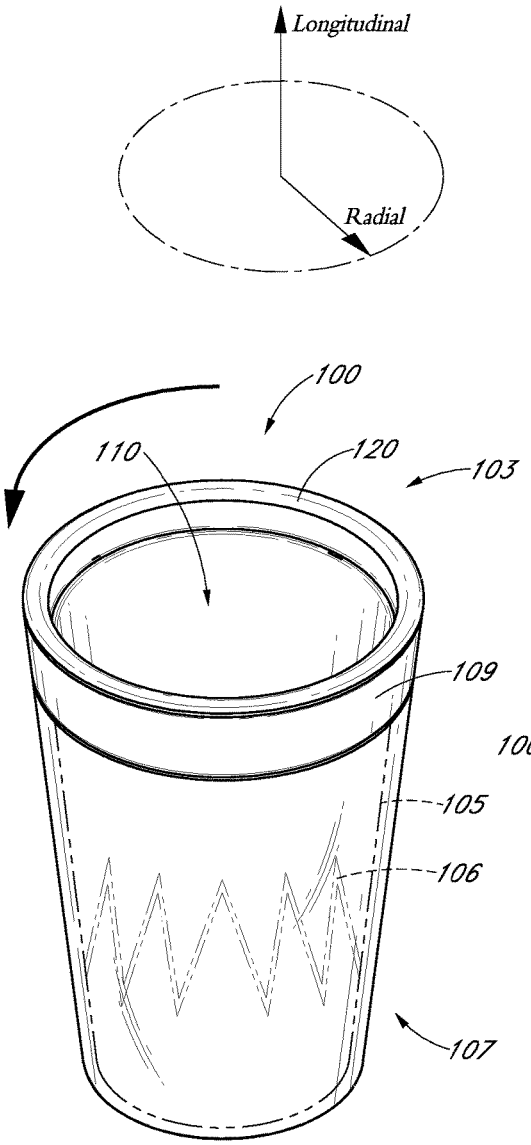
FIG. 3 is a perspective view of the housing of FIG. 1.
Figure 4:
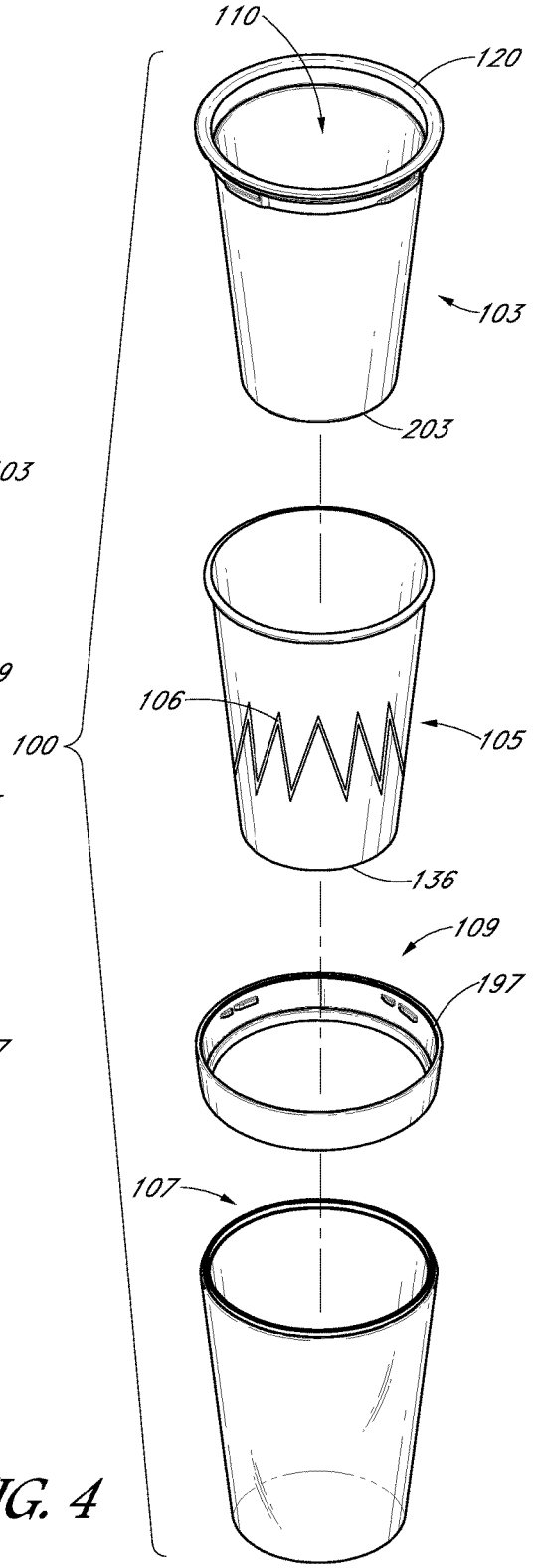
FIG. 4 is an exploded perspective view of the housing of FIG. 3.

Turning to FIGS. 3-4, FIG. 3 shows a perspective view of FIG. 1 and FIG. 4 shows an exploded view of FIG. 3. As will be described in further detail below, the coupling 109 and the inner shell 103 may be configured such the coupling 109 and the inner shell 103 are secured together when the inner shell 103 is rotated about the longitudinal axis with respect to the coupling 109 and/or the outer shell 107. When secured to the coupling 109, the inner shell 103 is prevented from moving in the longitudinal direction with respect to the coupling 109 and/or the outer shell 107. In some embodiments, when the inner shell 103 is secured to the coupling 109, the inner shell 103 is prevented from moving radially in a clockwise or counterclockwise direction with respect to the coupling 109 and/or the outer shell 107. In some embodiments, the inner shell 103 is secured to the coupling 109 and/or the outer shell 107 by inserting the inner shell 103 into the coupling 109 and/or outer shell 107 and rotating the inner 103 shell about 90° (or about a quarter turn) with respect to the coupling 109 and/or outer shell 107.

The beverage container housing system 100 may be used in the following manner. A user may rotate the inner shell 103 with respect to the outer shell 107 in a counterclockwise direction. This rotation of the inner shell 103 with respect to the outer shell 107 unlocks the inner shell 103 from the outer shell 107. In some embodiments, the inner shell 103 is unlocked from the outer shell 107 after the inner shell 103 is rotated about 90° or less with respect to the outer shell 107. The inner shell 103 may then be pulled in the longitudinal direction away from the outer shell 107 and removed from the outer shell 107. A beverage container may be provided. The beverage container may comprise a disposable cup 105. The cup 105 may contain a beverage. The beverage may be poured out of the cup 105 and into the inner shell 103. The cup 105 may then be placed inside the outer shell 107. The inner shell 103 may then be placed within the cup 105 disposed within the outer shell 107. The inner shell 103 may then be rotated clockwise with respect to the outer shell 107 to secure the inner shell 103 to the outer shell 107. In some embodiments, the inner shell 103 is locked to the outer shell 107 after the inner shell 103 is rotated about 90° or less with respect to the outer shell 107 in the clockwise direction. A lid may then be placed over the inner shell 103.

Figure 5:
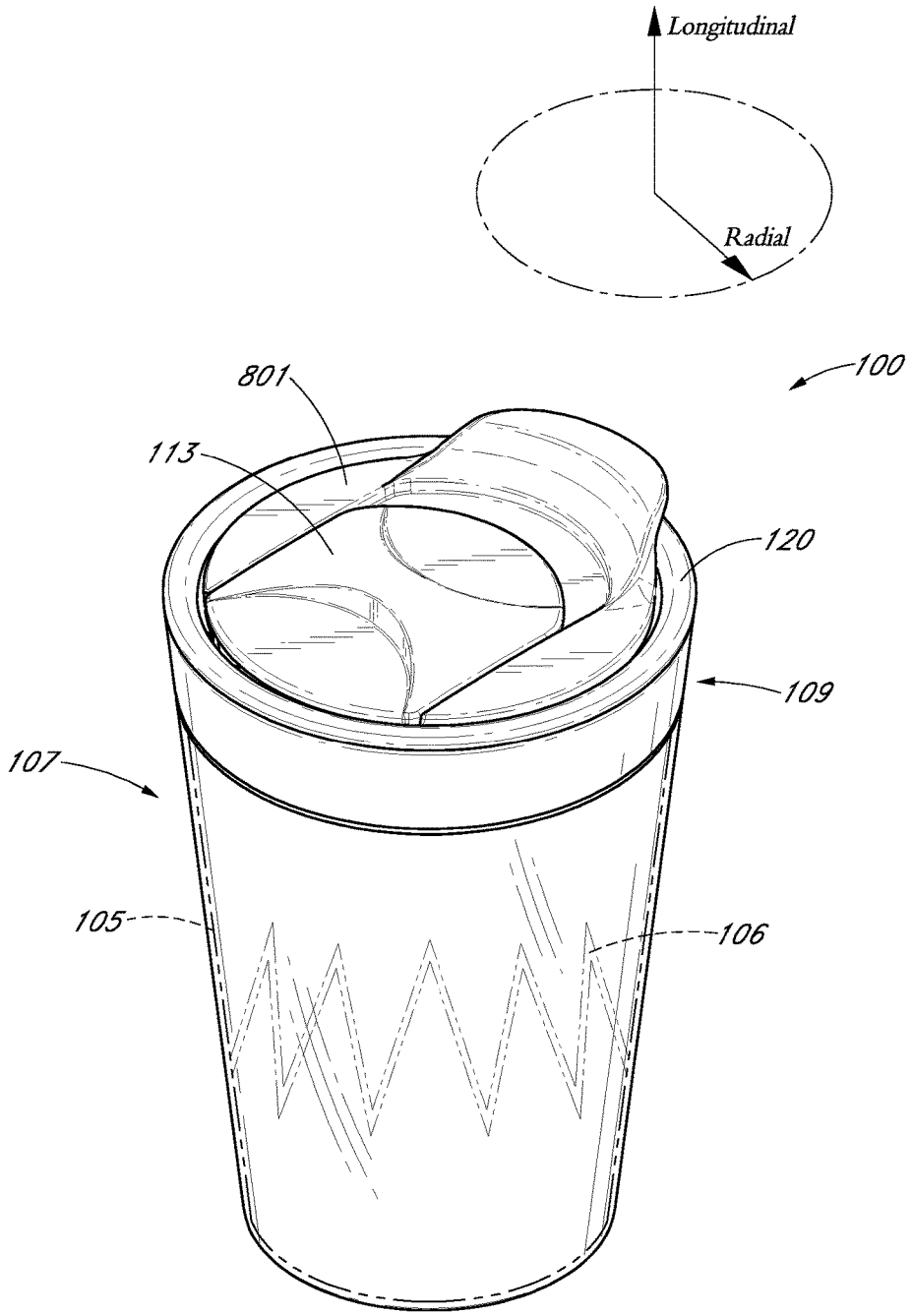
FIG. 5 is the same as FIG. 3 except that a lid is shown. The lid covers the opening in the housing. The lid is shown in the closed position.
Figure 6:
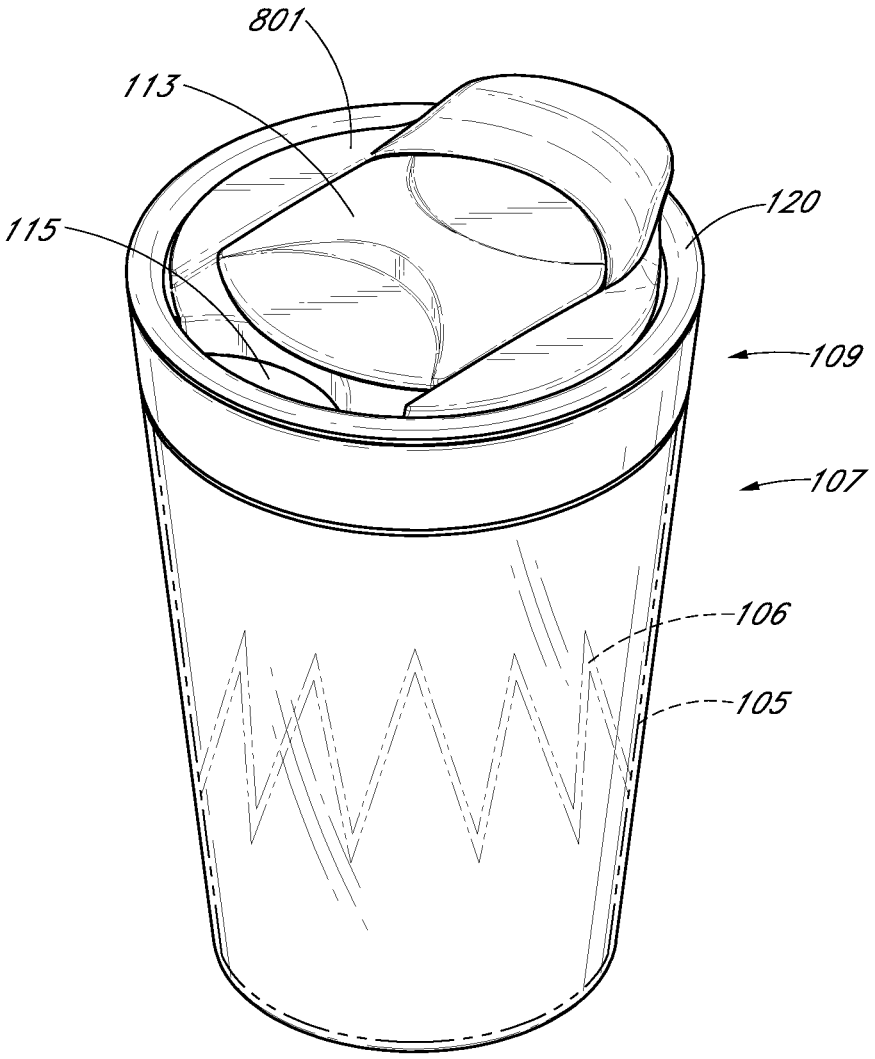
FIG. 6 is the same as FIG. 5 except that the lid is shown in the open position. In this way, a user may drink a beverage that is placed within the housing.

Moving on to FIGS. 5-6, the beverage container housing system 100 may further include a lid 801. The lid 801 may be configured to be at least partially inserted into the inner shell 103. The lid 801 may include an opening 115 and a sliding closure 113. The sliding closure 113 may be configured to be positioned in at least a closed position and an open position. FIG. 5 shows the sliding closure 113 in the closed position. In this way, the sliding closure 113 covers the opening 115 in the lid. FIG. 6 shows the sliding closure 113 in the open position to expose the opening 115. The lid 801 may insulate a beverage placed within the inner shell 103. The lid 801 may also help a beverage placed within the inner shell 103 from spilling out from the inner shell 103. Further details of the lid 801 and related components may be seen in FIGS. 41-60 and are described below.

Figure 7:
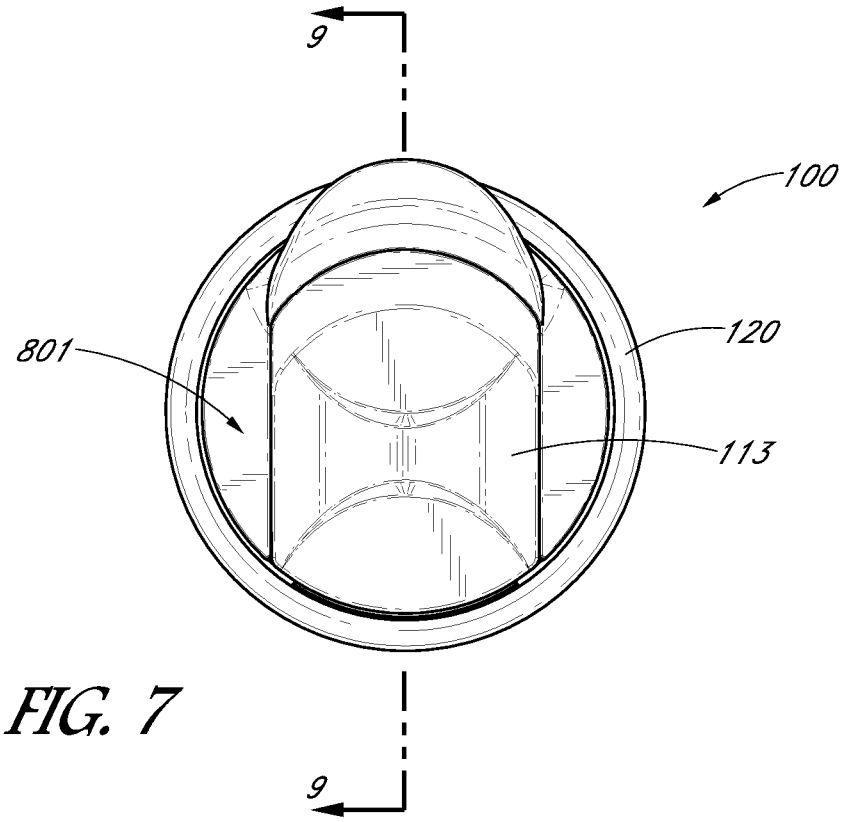
FIG. 7 is a top view of the housing and lid shown in FIG. 5.

FIG. 7 is a top view of the beverage container housing system 100 including the lid 801. As shown in FIG. 7, in some embodiments, the lid 801 is sized and shaped to be at least partially inserted into the inner shell 103 such that, when viewed from above, the flange 120 of the inner shell 103 surrounds the lid 801.

Figure 8:
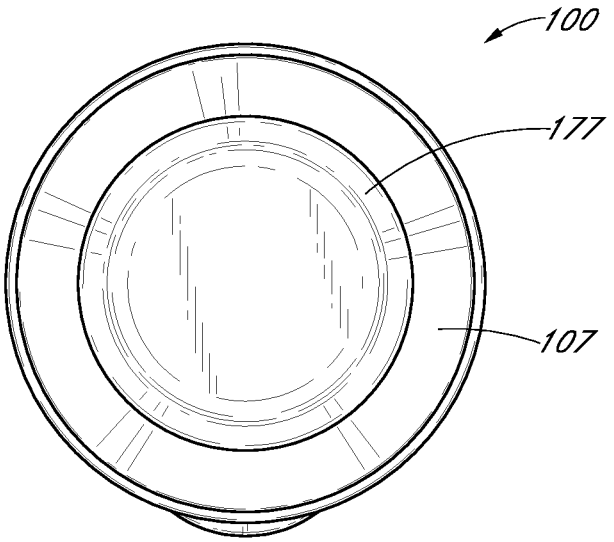
FIG. 8 is a bottom view of the housing and lid shown in FIG. 5.
Figure 9:
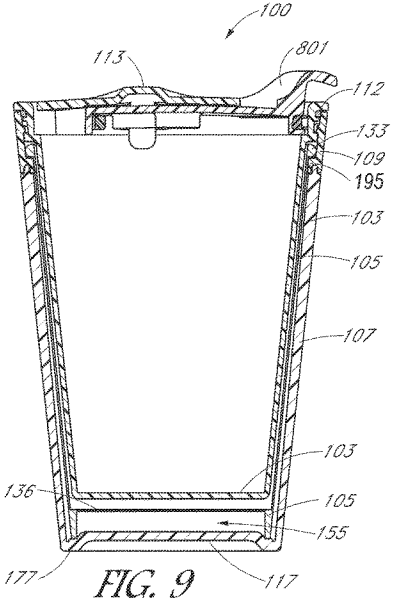
FIG. 9 is a cross-sectional view of the housing and lid taken about the line 9-9 in FIG. 7. The lid is shown in the closed position.

FIG. 8 is a bottom view of the beverage container housing system 100 including the lid 801 detailing the base 177 if the outer shell 107. The base 177 may be substantially flat. In some embodiment, the base 177 includes a recessed portion 117. In this way, less material of the base comes in contact with the surface on which the base 177 is placed on. That is to say, in some embodiments, only outer rim of the base 177 comes into contact when the outer shell rests on a surface. FIG. 9 also illustrated the recess portion 117 of the base 177.

FIG. 9 is a cross-sectional view of the beverage container housing system 100 including the lid 801 taken about the line 9-9 in FIG. 7. FIG. 10 is the same as FIG. 9 but with the sliding closure 113 of the lid 801 in the open position to provide an opening 115. As shown, the inner shell 103 is sized and shaped to fit within the outer shell 107 and sized and shaped to form a space between the outer shell 107 and the inner shell 105. The space between the inner shell 103 and the outer shell 107 may be sized and shaped to house a disposable cup 105. As shown, similar to the outer shell 107, the cup 105 may also include a recessed portion 155 such that the base 136 of the cup does not come into direct contact with the outer shell 107. In this way, a beverage in the cup 105 may be further insulated. However, such a configuration is optional and is not required.

As also shown in FIGS. 9-10, the outer shell 107 may include a base 177 having a recess 117 disposed therein. The disposable cup 105 may be supported from below by the base 177 of the outer shell 107. The inner shell 103 may then be inserted into the disposable cup 105. As shown, the inner shell 103 may not contact the base 136 of the disposable cup 105. In some embodiments, the inner shell 103 may include a flange that contacts the upper rim of the coupling 109, thus spacing the inner shell 103 away from the base 136 of the cup 105. In some embodiments the inner shell 103 may be sized and shaped such that at least a portion of the walls of the inner shell 103 contact at least a portion of the walls of the cup 105. In other embodiments the inner shell 103 is sized and shaped such that at no portion of the walls of the inner shell 103 contact any portion of the walls of the cup 105.

Figure 10A:
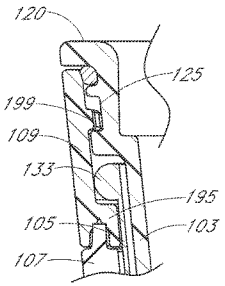
FIG. 10A is an enlarged view of FIG. 10 taken about the line 10A.
Figure 10:
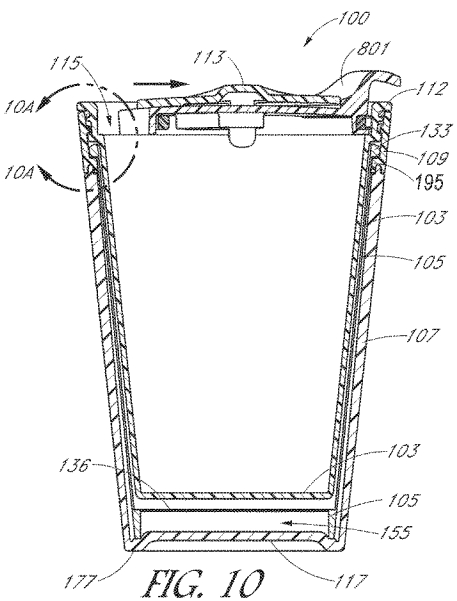
FIG. 10 is the same as FIG. 9 except that the lid is shown in the open position.

FIG. 10A details the interactions between the coupling 109, the disposable cup 105, and the inner shell 103 when the beverage container housing system 100 is assembled to house a cup 105. As best seen in FIG. 10A, the coupling 109 may include at least one protrusion 199 extending from an interior facing surface. In this embodiment, the coupling 109 includes at least one receiving space 125 positioned on an exterior facing surface of the inner shell 103. The receiving space 125 may be configured to receive the protrusion 199. In this way, when the protrusion 199 is disposed within the receiving space 125, the inner shell 103 is prevented from moving in at least the longitudinal direction with respect to the coupling 109.

Continuing with FIG. 10A, the disposable cup 105 may include a top rim having an outwardly extending flange 133. The coupling 109 may also include an inwardly extending lip 195. The lip 195 may be positioned below the protrusion 199. The lip 195 may be configured to support the outwardly extending flange 133 of the disposable cup 105 from below. Thus, at least a portion of the cup 105 may contact at least a portion of the coupling 109. In this way, the cup 105 may be prevented from moving in a longitudinal direction when the cup 105 is secured within the housing 100.

Figures 11, 12, 13:
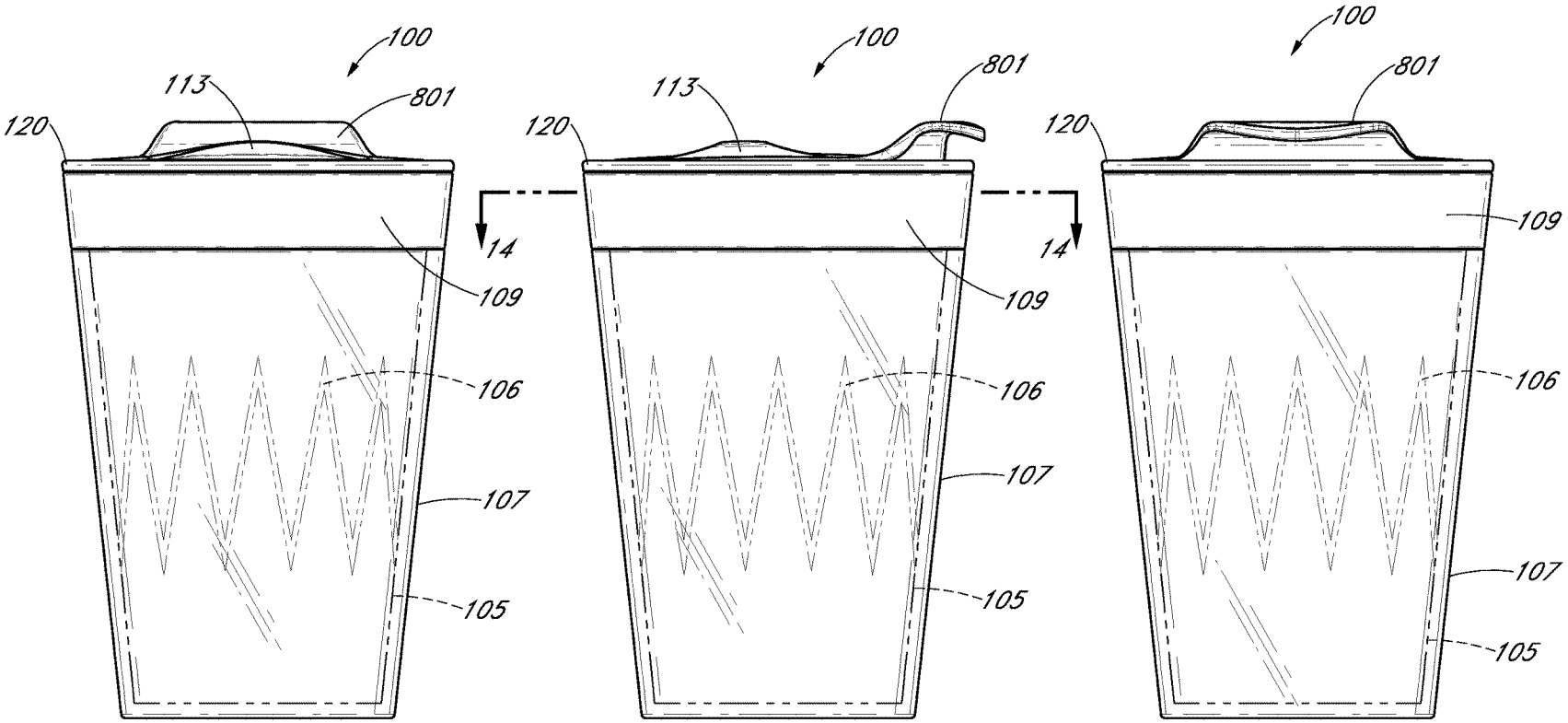
FIG. 11 is a front view of the housing and lid shown in FIG. 5.
FIG. 12 is a side view of the housing and lid shown in FIG. 5.
FIG. 13 is a rear view of the housing and lid shown in FIG. 5.

FIG. 11 is a front view of the beverage container housing system 100 including the lid 801, FIG. 12 is a side view of the beverage container housing system 100 including the lid 801, and FIG. 13 is a rear view of the beverage container housing system 100 including the lid 801. As shown, the majority of the disposable cup 105 can be viewed through the substantially transparent walls of the outer shell 107. In FIGS. 11-13, the majority of the disposable cup 105 is visible through the substantially transparent walls of the outer shell 107. However, in some embodiments, portions of the outer shell 107 may not be transparent such that a cup 105, positioned within the outer shell 107, is at least partially obscured from view. FIGS. 11-13 also illustrate that the coupling 109 may not be transparent. In this way, the coupling mechanism and the upper-most portions of the disposable cup 105 may be hidden from view.

Figure 14:
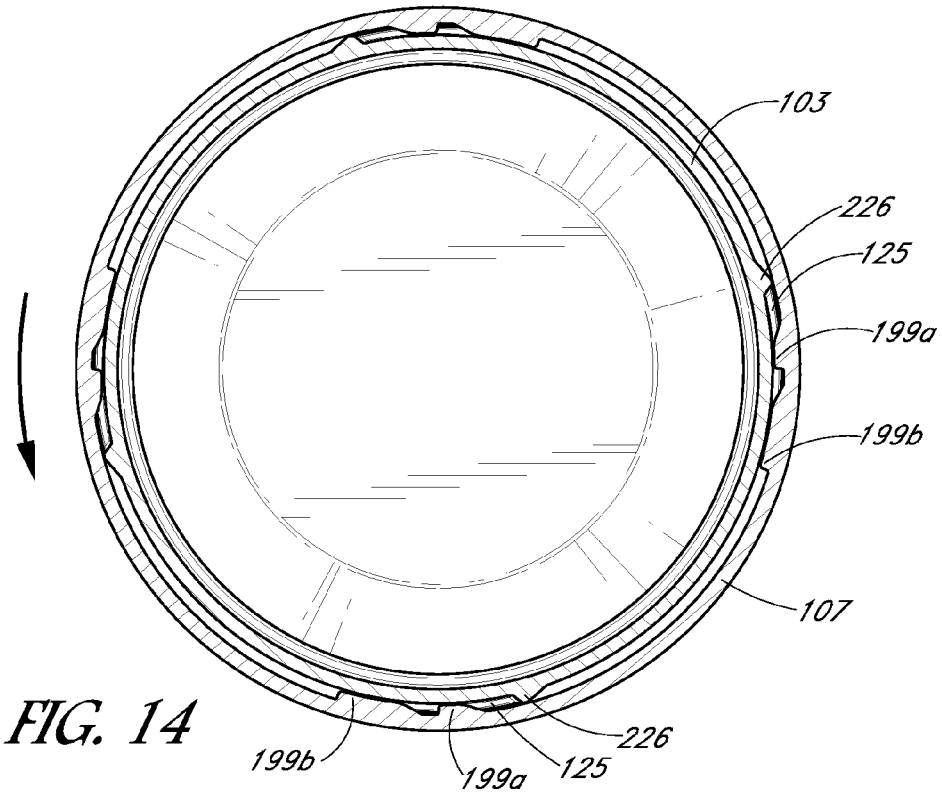
FIG. 14 is a cross-sectional view of the housing taken about the line 14-14 in FIG. 12.
Figure 15:
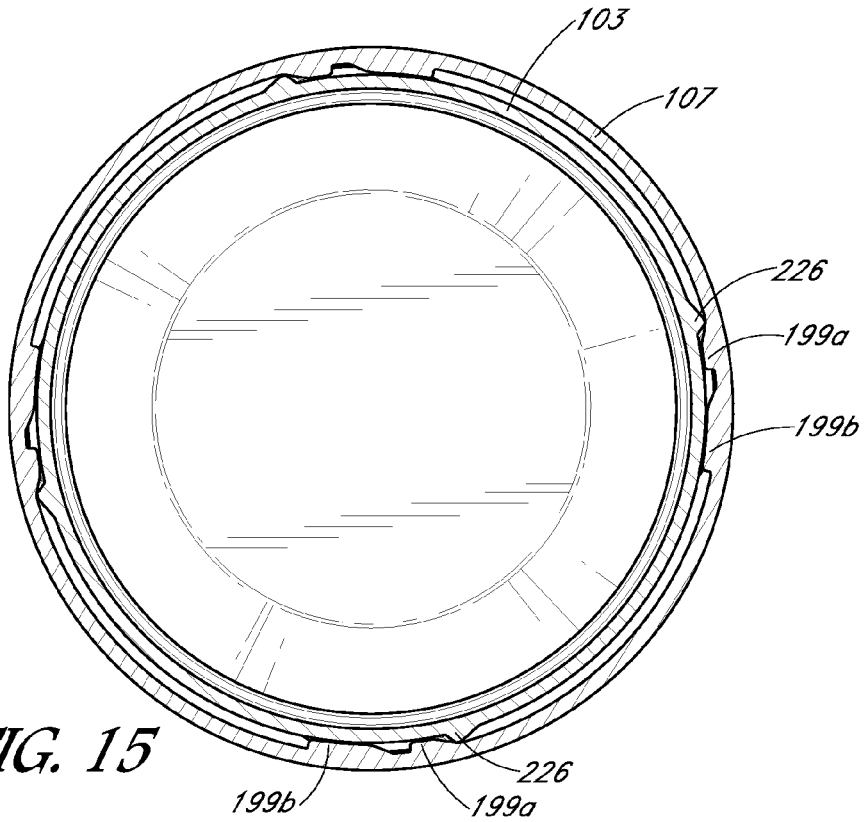
FIG. 15 is the same as FIG. 14 expect that the outer shell has been rotated with respect to the inner shell. Thus.
Figure 16:
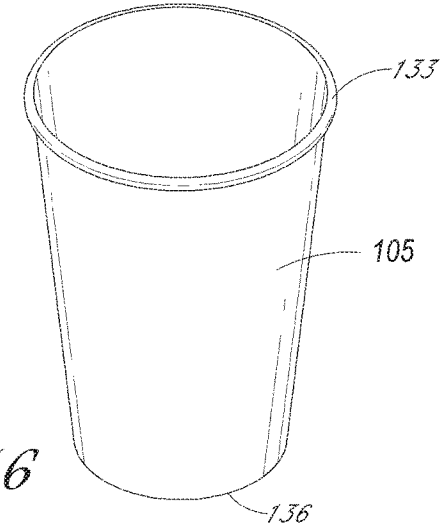
FIG. 16 is a perspective view of the beverage container of FIG. 2.
Figure 17:
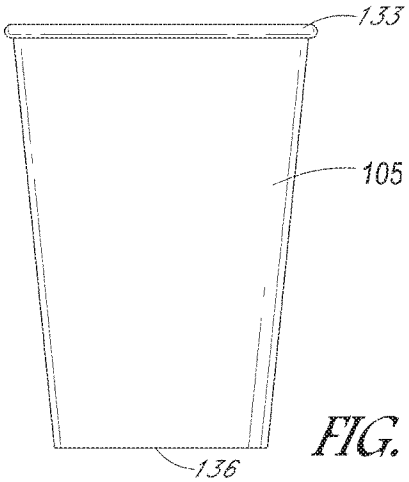
FIG. 17 is a front view of the beverage container of FIG. 16.
Figure 18:
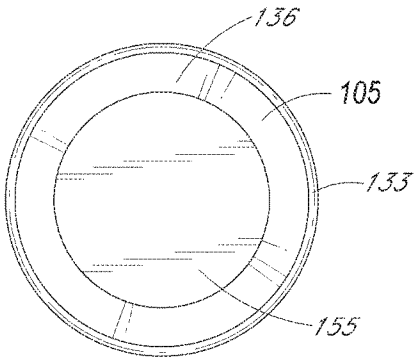
FIG. 18 is a top view of the beverage container of FIG. 17.
Figure 19:
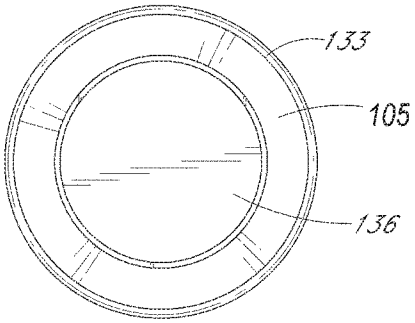
FIG. 19 is a bottom view of the beverage container of FIG. 17.
Figure 21:
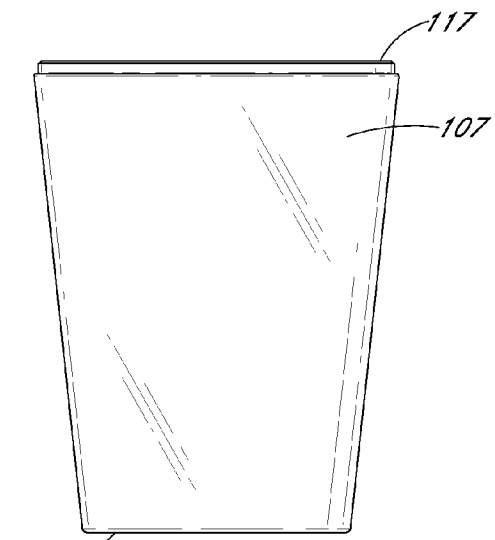
FIG. 21 is a side view of the outer shell of FIG. 20.
Figure 23:
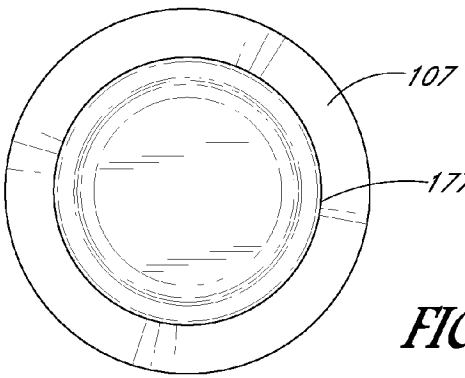
FIG. 23 is a bottom view of the outer shell of FIG. 21.

FIG. 14 is a cross-sectional view of the beverage container housing system 100 taken about the line 14-14 in FIG. 12. FIG. 14 illustrates the beverage container housing system 100 in an un-locked or un-secured position. FIG. 15 is the same as FIG. 14 except that the beverage container housing system 100 is shown in the locked or secured position. As will be further explained below, the coupling 109 may include one or more protrusions that extend inward. In the illustrated embodiment, the protrusions comprise four pairs of protrusions 199*a* and 199*b* that are approximately equally spaced about the inner circumference of the coupling 109. While pairs of protrusions 199*a* and 199*b* are used in this illustrated embodiment, more or less protrusions may be used. In some embodiments, the protrusion pairs 199*a* and 199*b* comprise a single protrusion.

Continuing with FIGS. 14-15, the inner shell 103 may include raised features that extend away from an exterior facing surface of the inner shell 103. These raised features may form a plurality of receiving spaces 125 and abutments 226. See, e.g., FIG. 33A. The receiving spaces 125 and abutments 226 may be approximately equally spaced about the outer circumference of the inner shell 103. As shown in FIGS. 14-15 when the inner shell 103 is rotated counterclockwise with respect to the coupling 109, the pairs of protrusions 199*a* and 199*b* are moved into the receiving spaces 125. Furthermore, protrusions 199*a* come into contact with the abutments 226. Thus, the abutments 226 prevent the inner shell 103 from rotating further in the counterclockwise direction. The interaction between the receiving spaces 125, abutments 226, and the pairs of protrusions 199*a* and 199*b* prevent the inner shell 103 from moving in the longitudinal direction with respect to the coupling 109 and the outer shell 107.

FIGS. 16-36 detail the various component parts of the beverage container housing system 100. FIGS. 16-19 illustrate the cup 105 according to one embodiment. As discussed above, the cup 105 may include a base 136. In the illustrated embodiments, the base 136 is circular in shape. However, other shapes are contemplated depending on the type of disposable container that is desired. An upwardly extending wall may extend from the base 136. The upwardly extending wall may end with a circular top rim having an outwardly extending flange 133. The disposable cup 105 may include a graphic design 106 disposed on the upwardly extending wall. See, e.g., FIGS. 1-2.

Figure 20A:
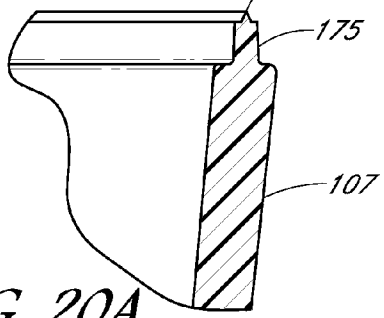
FIG. 20A is an enlarged cross-section view of FIG. 20 taken about the line 20A-20A.
Figure 22:
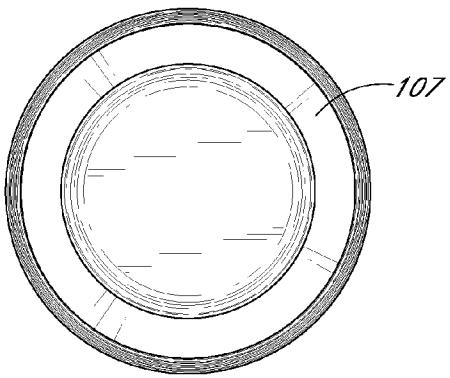
FIG. 22 is a top view of the outer shell of FIG. 21.
Figure 20:
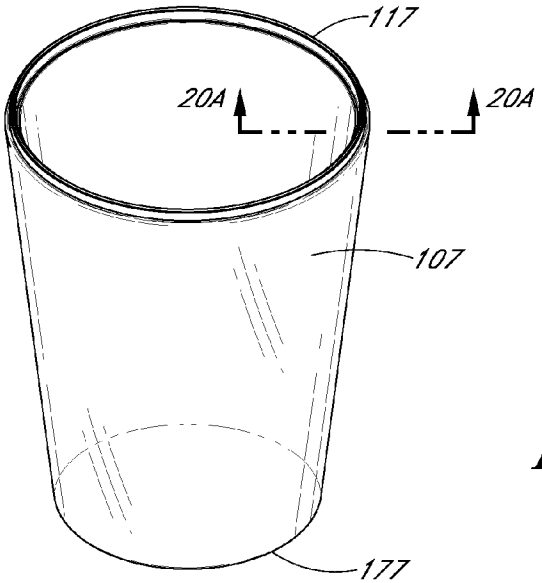
FIG. 20 is a perspective view of the outer shell of FIG. 2.
Figure 25:
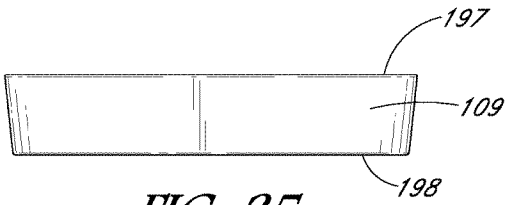
FIG. 25 is a side view of the coupling of FIG. 24.
Figure 27:
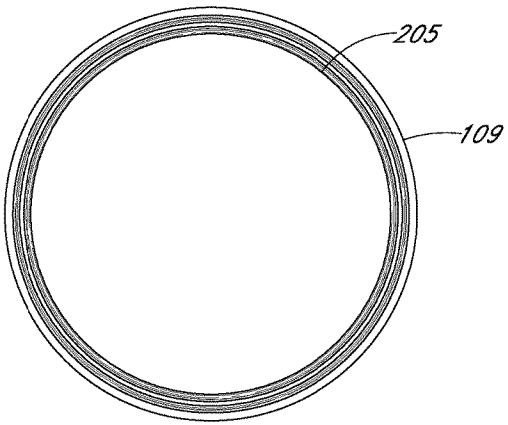
FIG. 27 is a bottom view of the coupling of FIG. 25.
Figure 24:
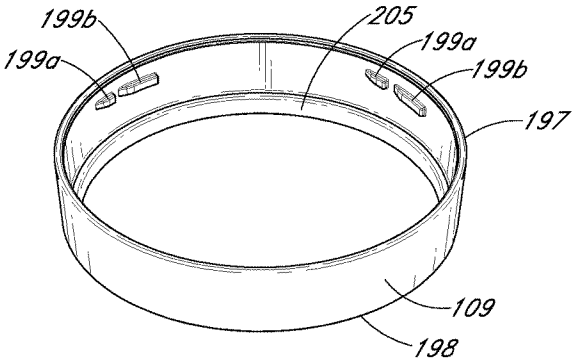
FIG. 24 is a perspective view of the coupling of FIG. 2.
Figure 26:
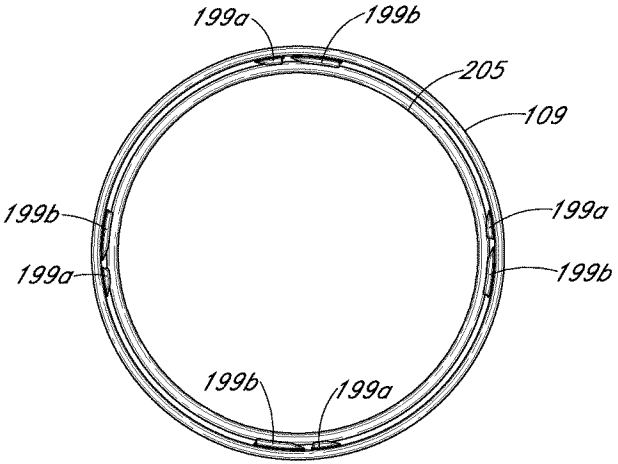
FIG. 26 is a top view of the coupling of FIG. 25.
Figure 29:
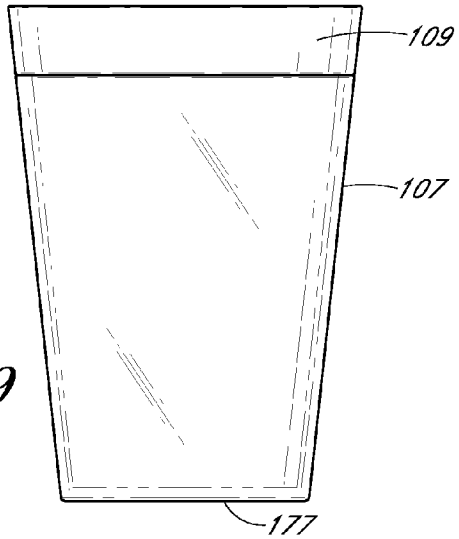
FIG. 29 is a side view of the outer shell and coupling of FIG. 28.
Figure 31:
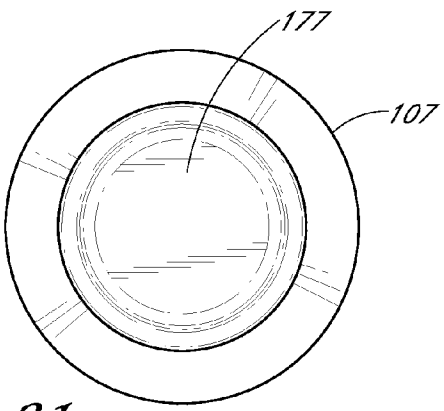
FIG. 31 is a top view of the outer shell and coupling of FIG. 29.
Figure 30:
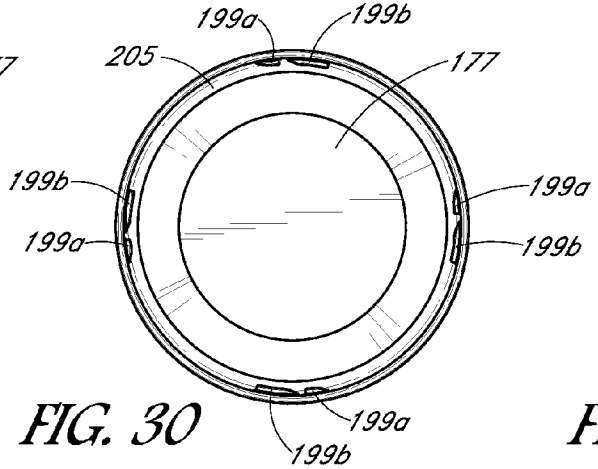
FIG. 30 is a bottom view of the outer shell and coupling of FIG. 29.
Figure 28:
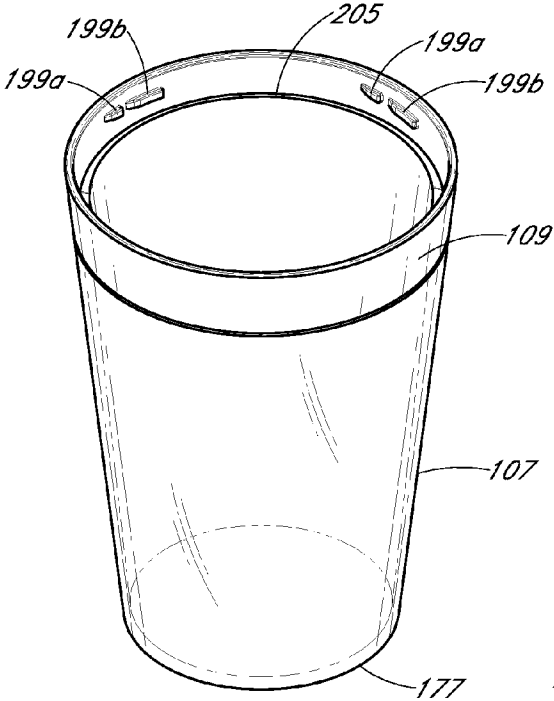
FIG. 28 is a perspective view of the outer shell of FIG. 20 attached to the coupling of FIG. 24.

FIGS. 20-23 illustrate the outer shell 107 according to one embodiment. The outer shell 107 is sized and shaped to house the disposable cup 105. As such, the outer shell 107 may be shaped in a variety of different ways depending on the type of container and/or disposable cup 105. As shown, the outer shell 107 includes a circular base 177 and upwardly extending walls that end at a circular rim 117. As best shown in FIG. 20A, the circular rim 117 may include a portion that is narrower than the width of the upwardly extending walls. In this way, a male press fitting edge 175 may be formed.

FIGS. 24-27 illustrate the coupling 109 according to one embodiment. As shown the coupling comprises a ring having a top surface 197 and a bottom surface 198. The bottom surface 198 may include a female press fitting edge. The female press fitting edge may be configured to receive the male press fitting edge 175 of the outer shell 107. Thus, the coupling 109 may be secured to the outer shell 107 by applying an adhesive on the male press fitting edge 175 and/or the female press fitting edge and inserting the male press fitting edge 175 into the female press fitting edge. Other means of securing the coupling 109 to the outer shell 107 may be implemented. For example, the coupling 109 may be attached to the outer shell 107 by welding, heat fusion, epoxy, screw, mechanism, and the like. In other embodiments, the outer shell 107 and coupling 109 are formed from a unitary construction. In this way, the outer shell 107 may be said to include coupling features. As detailed above, a plurality of protrusion pairs 199*a* and 199*b* may extend from the interior facing surfaces of the coupling 109. The coupling 109 may also include an inwardly extending lip 205. The inwardly extending lip 205, may contact at least a portion of the inner shell 103 when the housing 100 is assembled.

FIGS. 28-31 illustrate the coupling 109 fixedly attached to the outer shell 107. While shown as two separate components secured together, in some embodiments the coupling and outer shell are formed from one unitary piece. In other words, in some embodiments, the outer shell includes a coupling.

FIGS. 32-35 illustrate the inner shell 103 according to one embodiment. As best shown in FIGS. 33 and 33A, a plurality of roughly "L" shaped raised features 225 extend from the exterior facing surface of the inner shell 103. The inner shell 103 may also include an outwardly extending collar 227. The collar 227 may be located below the flange 120 extending from the top rim of the inner shell 103. In this way, the raised features 225 and the collar 227 form a plurality of receiving spaces 125 and abutments 226. The receiving spaces 125 may be configured to receive at least one protrusion extending from the coupling 109 and/or the outer shell 107.

As best shown in FIG. 32, the inner shell 103 may include an inwardly extending lip 229. The lip 229 may be used to at least partially support a lid 801 from below. In some embodiments, the 229 may help create a seal between the inner shell 103 and the lid 801.

Figure 36:
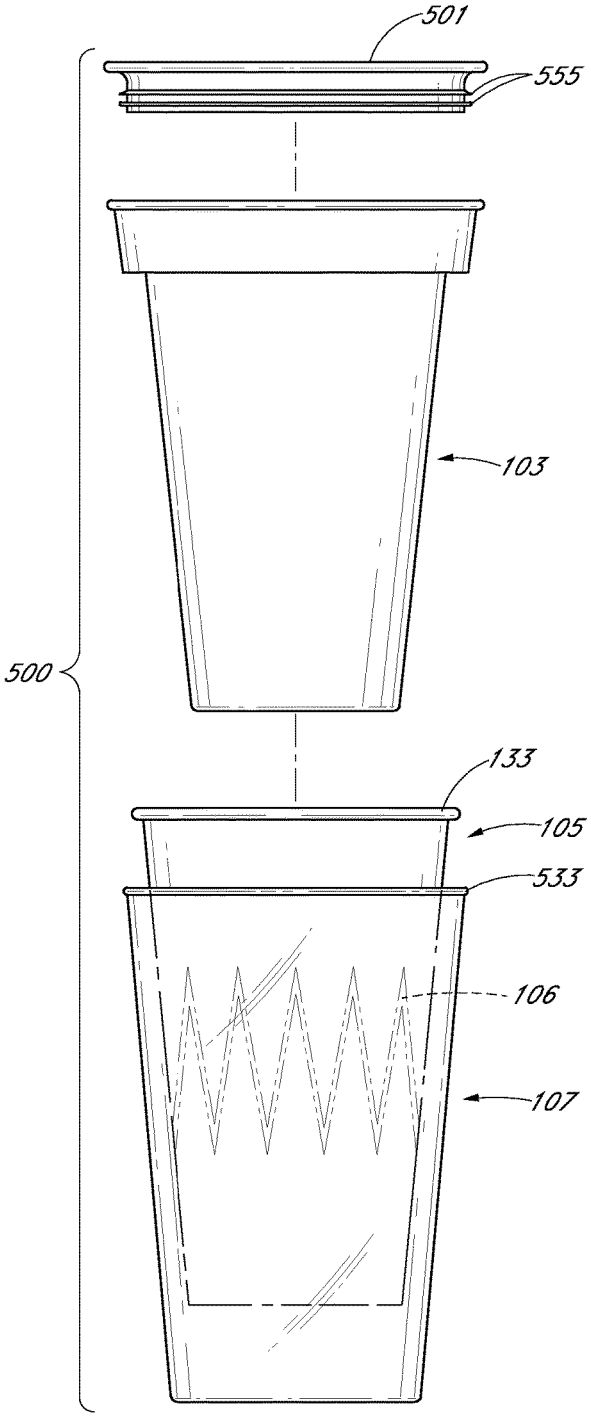
FIG. 36 is an exploded view of a housing for a beverage container according to another embodiment. From top to bottom, a lid, an inner shell, a beverage container, and an outer shell are illustrated.
Figure 37:
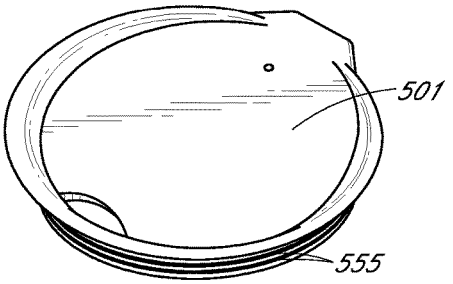
FIG. 37 is a perspective view of the lid of FIG. 36.
Figure 38:
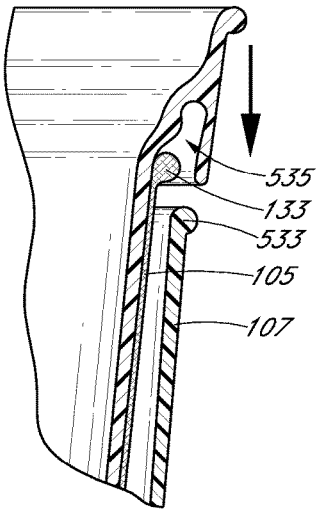
FIG. 38 is an enlarged cross-section view illustrating the coupling between the inner shell, beverage container, and outer shell of FIG. 36.

Turning to FIGS. 36-38, a beverage container housing system 500 according to another embodiment is illustrated. The beverage container housing system 500 is substantially similar to the beverage container housing system 100 described above, except that a different coupling means is used to secure the inner shell, outer shell, and cup. As shown in FIG. 36, the beverage container housing system 500 may include a lid 501, an inner shell 103, a cup 105, and an outer shell 107. In some embodiments, the lid 501 and/or cup 105 are not included. The lid 501 may be sized and shaped such that at least portion of the lid is insertable into the inner shell 103. As shown, the lid 501 may include one or more compressible rings 555 to seal the lid 501 within the opening of the inner shell 103.

FIG. 38 illustrates coupling of the inner shell 103, outer shell 107, and cup 105. As shown, the inner shell 107 may include a receiving space 535 shaped to receive at least a portion of the cup 105 and the outer shell 107. In some embodiments, the receiving space 535 is shaped to receive the outwardly extending flange 133 of the cup 105 and a similar outwardly extending flange 533 of the outer shell 107. The outwardly extending flange 133 of the cup 105 may be inserted into the receiving space 535 of the inner shell 103. In some embodiments, the receiving space 535 may be shaped such that the outwardly extending flange 133 of the cup 105 is snap fit into the receiving space 535. In other words, the surfaces surrounding the receiving space 535 may exert at least some pressure on the outwardly extending flange 133 of the cup 105 when it is inserted into the receiving space 535. In this way, at least a portion of the cup 105 may be secured to the inner shell 103. At least a portion of the outer shell 107 may also be inserted into the receiving space 535 of the inner shell 103. Thus, at least a portion of the outer shell 107 may be secured to the inner shell 103. The insertion of the outer shell 107 may also apply additional pressure on the exterior surface of the cup 105 thus further securing the cup 105 to the inner shell 103.

Figure 39:
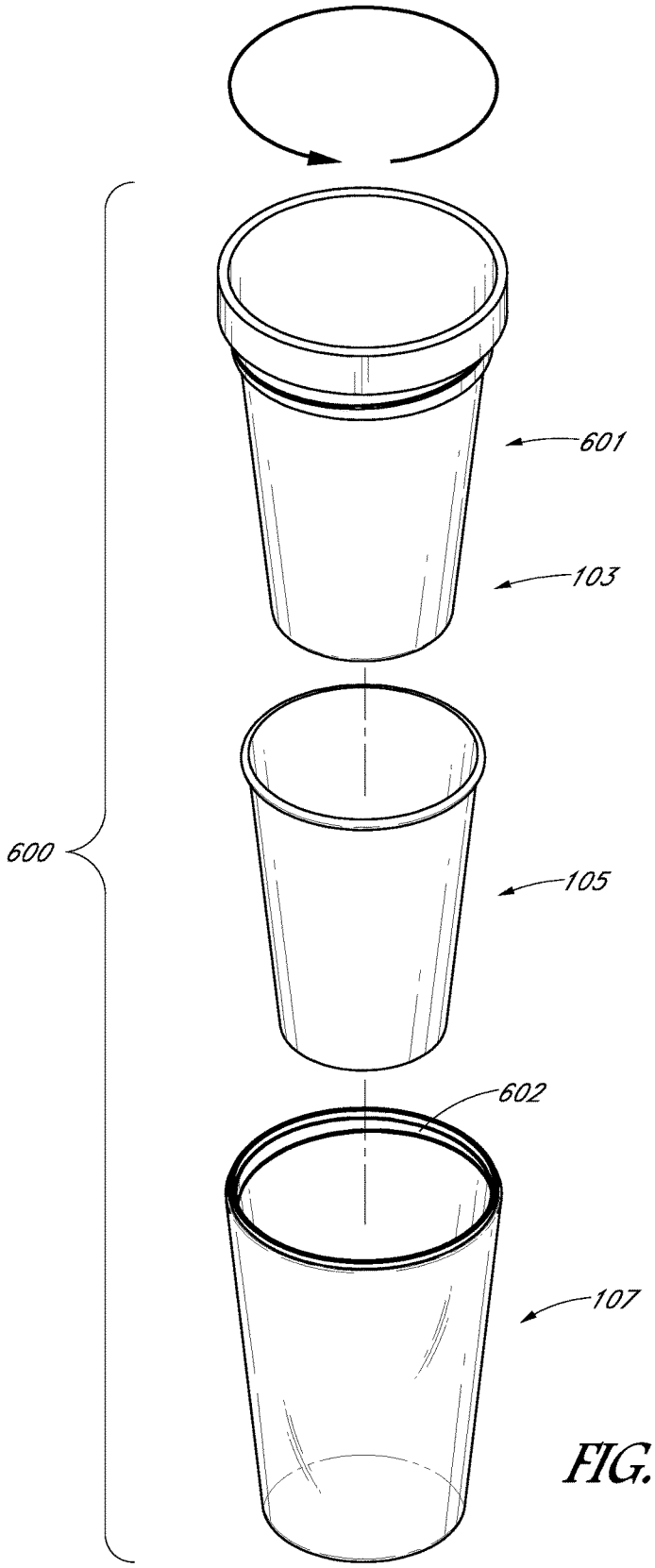
FIG. 39 is an exploded perspective view of a housing for a beverage container according to another embodiment. From top to bottom, a lid, an inner shell, a beverage container, and an outer shell are illustrated.

With reference now to FIG. 39, a beverage container housing system 600 according to another embodiment is illustrated. The beverage container housing system 600 is substantially similar to those systems described above except that the outer shell and inner shell are removably coupled together with a threaded connection. As shown, in FIG. 39, the beverage container housing system 600 may include an inner shell 103 and an outer shell 107. The system 600 may further include a cup 105 and/or a lid (not shown). The inner shell 103 may include a male threaded connection 601 disposed on the exterior facing surfaces of the inner shell 103 and the outer shell 107 may include a female threaded connection 602 disposed on the interior facing surfaces of the outer shell 107. In other embodiments, the inner shell 103 includes a female threaded connection disposed on the exterior facing surfaces of the inner shell 103 and the outer shell 107 includes a male threaded connection disposed on the interior facing surfaces of the outer shell 107. In some embodiments, the threaded connections 601 and 602 are configured such that the inner shell 103 is secured to the outer shell 107 when the inner shell 103 is rotated about 360° with respect to the outer shell 107. However, the threaded connections 601 and 602 may be configured to be secured by rotating more or less than 360° with respect to one another.

Figure 40:
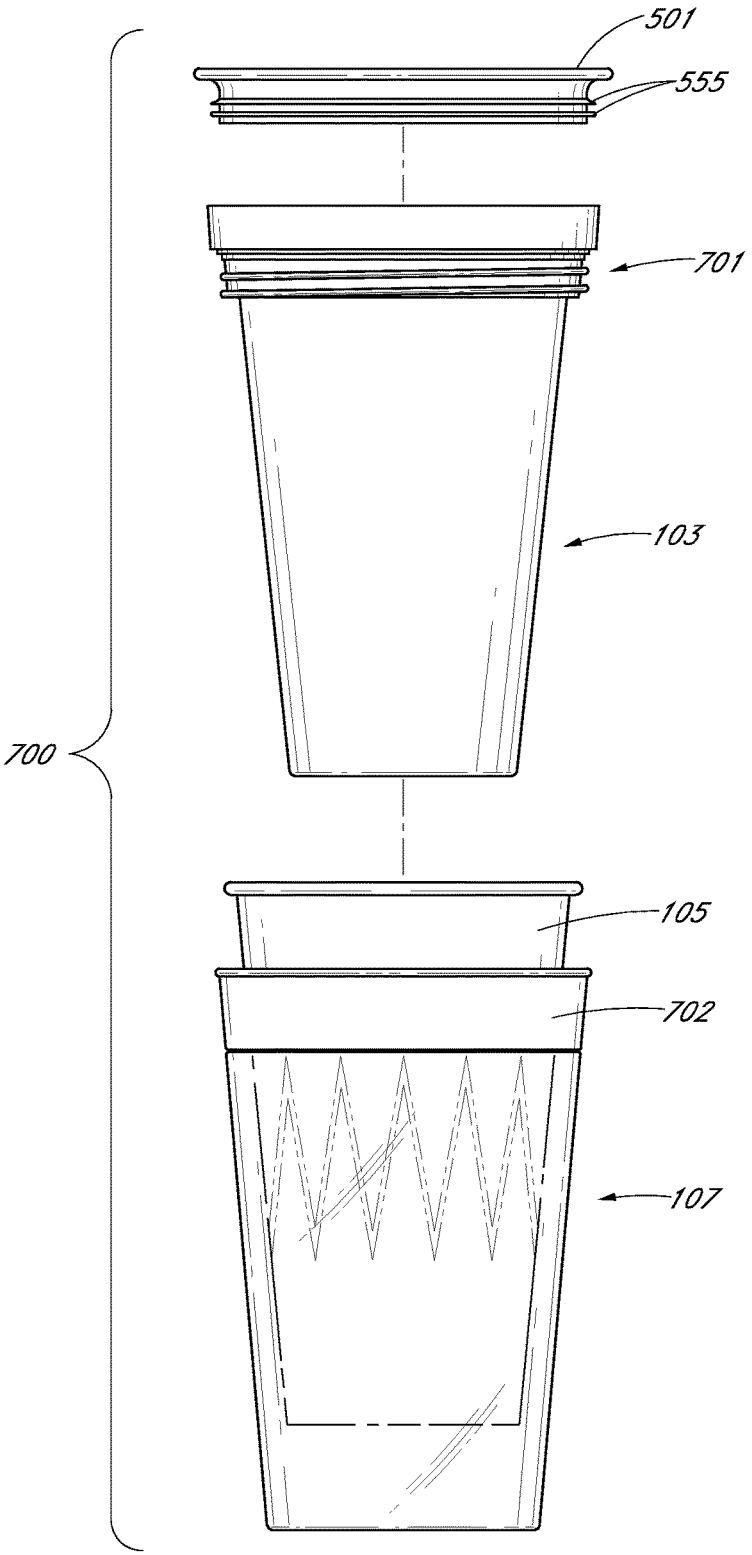
FIG. 40 is an exploded side view of a housing for a beverage container according to another embodiment. From top to bottom, an inner shell, a beverage container, and an outer shell are illustrated.

Moving on to FIG. 40, beverage container housing system 700 according to another embodiment is illustrated. The beverage container housing system 700 is substantially similar to those systems described above except that the outer shell and inner shell can be removably coupled together with a compressible press fitting. As shown, in FIG. 40, the beverage container housing system 700 may include an inner shell 103, an outer shell 107, a cup 105, and a lid 501. The cup 105 and a lid 501 are optional. The inner shell 103 may include a press fitting 701. The outer shell 107 may include a non-transparent portion 702. In some embodiments, the press fitting comprises one or more silicone or rubber based rings. The press fitting 701 may be configured such that the at least a portion of the press fitting 701 contacts at least a portion of the interior of the cup 105 when the inner shell 103 is inserted into the outer shell 107. In some embodiments, the press fitting 701 may supply an outwardly extending force that biases at least a portion of the cup 105 against an internal surface of the outer shell 107. In this way, the cup 105 may be prevented from moving in the longitudinal and/or radial direction when the inner shell 103 is inserted into the cup 105 and the outer shell 107. Various other means may be utilized to secure the inner shell 103 with the outer shell 107.

Figure 41:
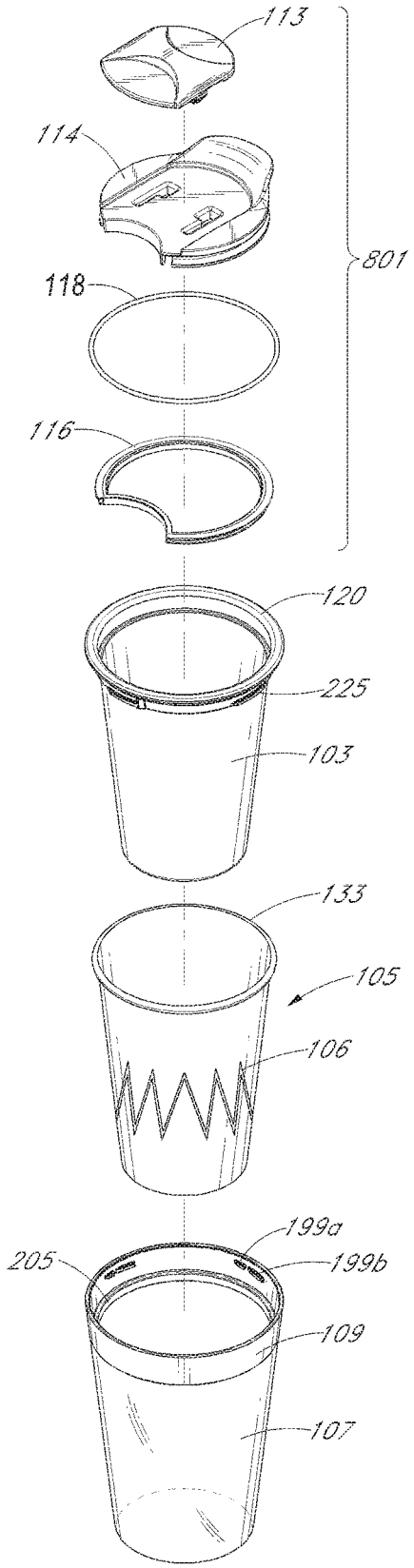
FIG. 41 is an exploded view of the housing for a beverage container and the lid of FIG. 5. From top to bottom, the lid assembly may include a slidable cover, a body, an O-ring, and a seal.
Figure 42:
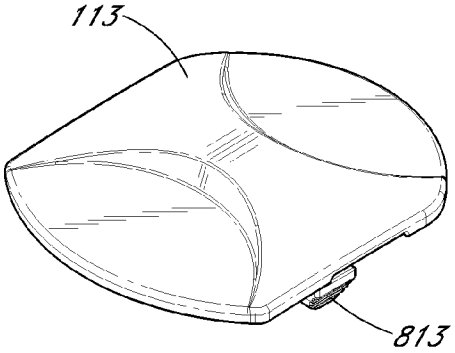
FIG. 42 is a perspective view of the cover of FIG. 41.
Figure 43:
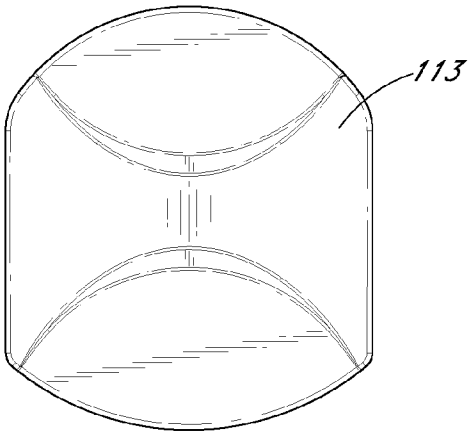
FIG. 43 is a top view of the cover of FIG. 42.
Figure 44:
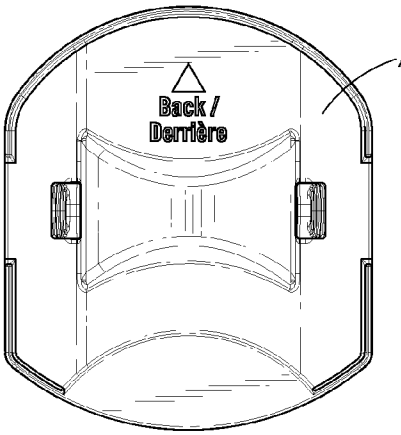
FIG. 44 is a bottom view of the cover of FIG. 42.
Figure 45:
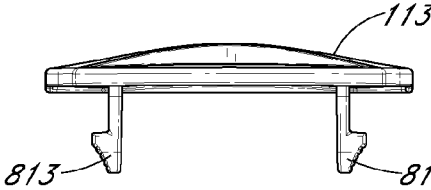
FIG. 45 is a front view of the cover of FIG. 42.
Figure 46:
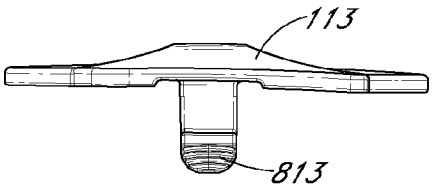
FIG. 46 is a side view of the cover of FIG. 42.
Figure 47:
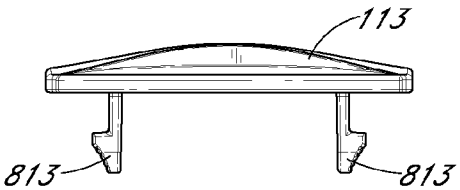
FIG. 47 is a rear view of the cover of FIG. 42.
Figure 50:
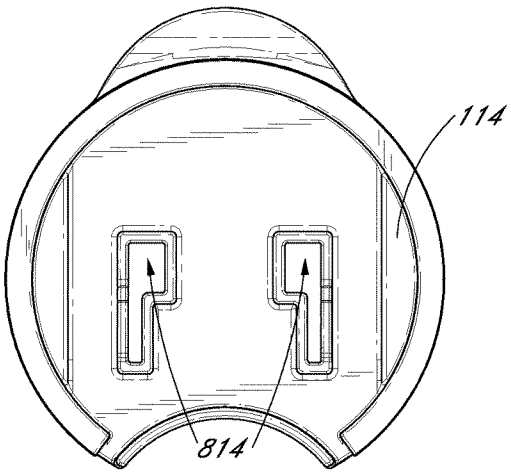
FIG. 50 is a bottom view of the lid body of FIG. 48.
Figure 49:
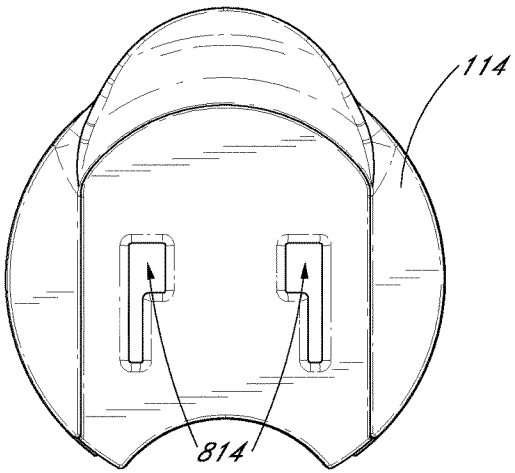
FIG. 49 is a top view of the lid body of FIG. 48.
Figure 48:
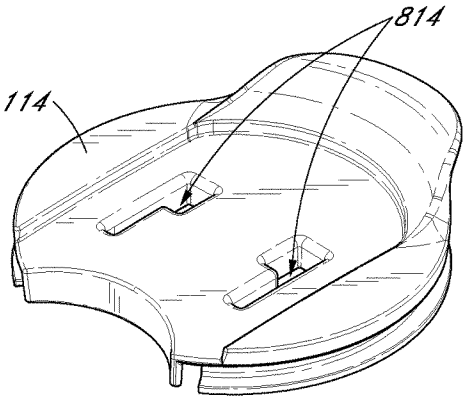
FIG. 48 is a perspective view of the lid body of FIG. 41.
Figure 53:
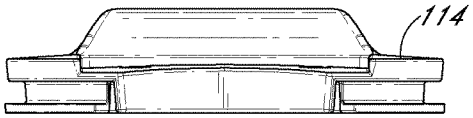
FIG. 53 is a rear view of the lid body of FIG. 48.
Figure 52:
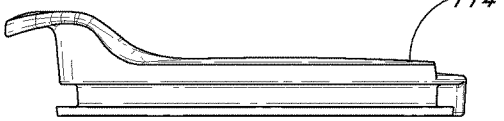
FIG. 52 is a side view of the lid body of FIG. 48.
Figure 51:
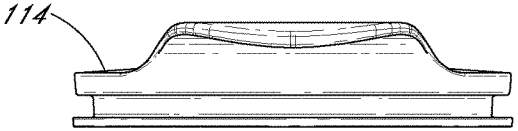
FIG. 51 is a front view of the lid body of FIG. 48.
Figures 61, 62, 63:
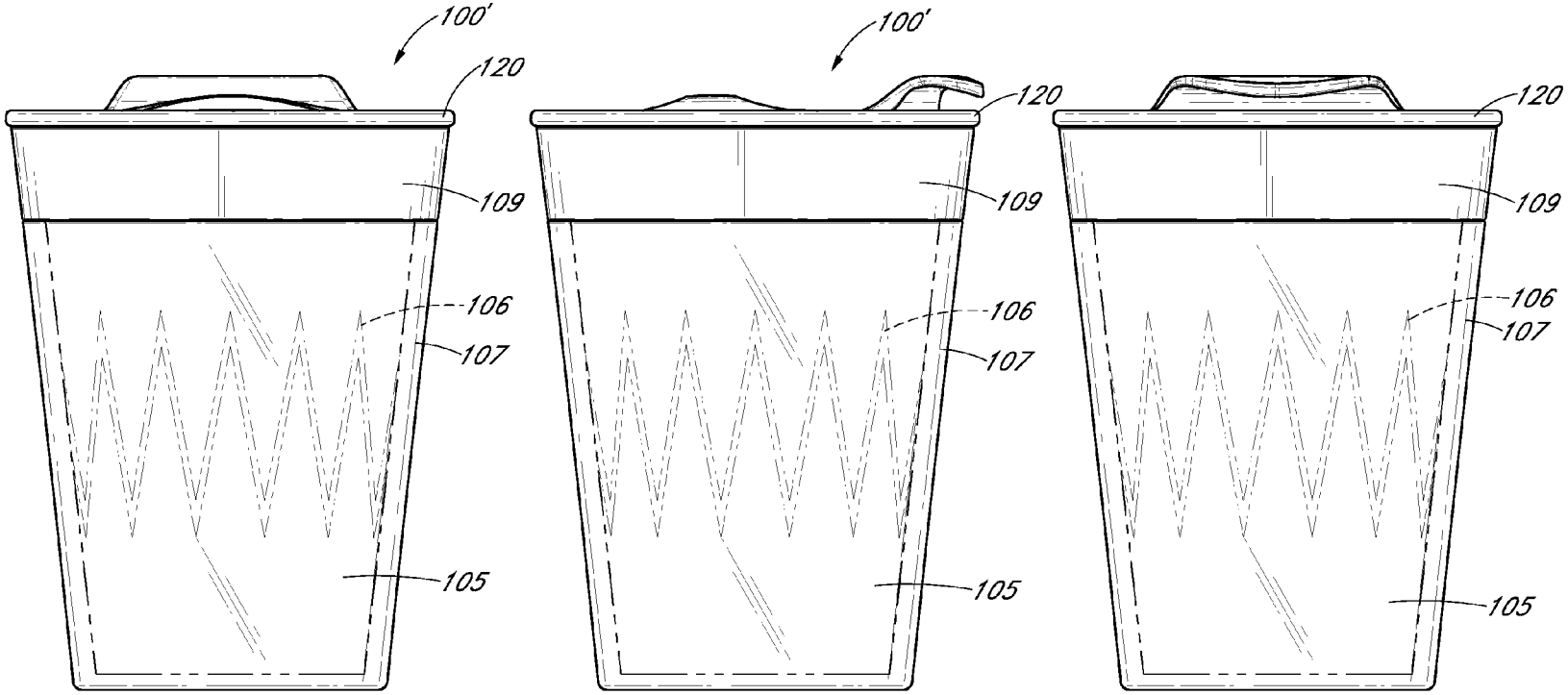
FIG. 61 is a front view of a housing and lid shown according to another embodiment. The embodiment is similar to the embodiment shown in FIG. 11.
FIG. 62 is a side view of the housing and lid shown in FIG. 61. The embodiment is similar to the embodiment shown in FIG. 12.
FIG. 63 is a rear view of the housing and lid shown in FIG. 61. The embodiment is similar to the embodiment shown in FIG. 13.
Figure 64:
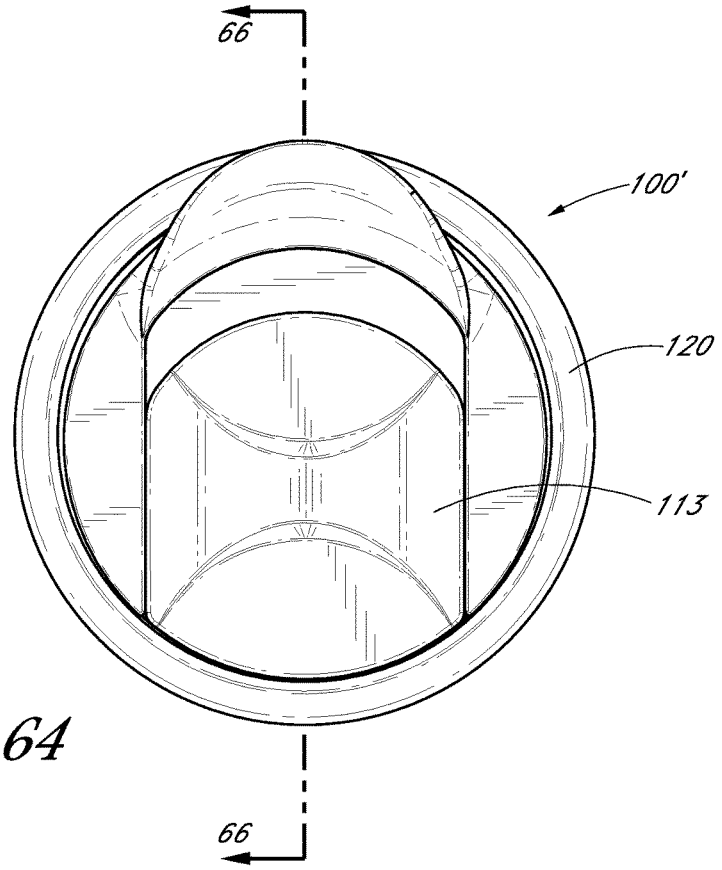
FIG. 64 is a top view of the housing and lid shown in FIG. 61.
Figure 65:
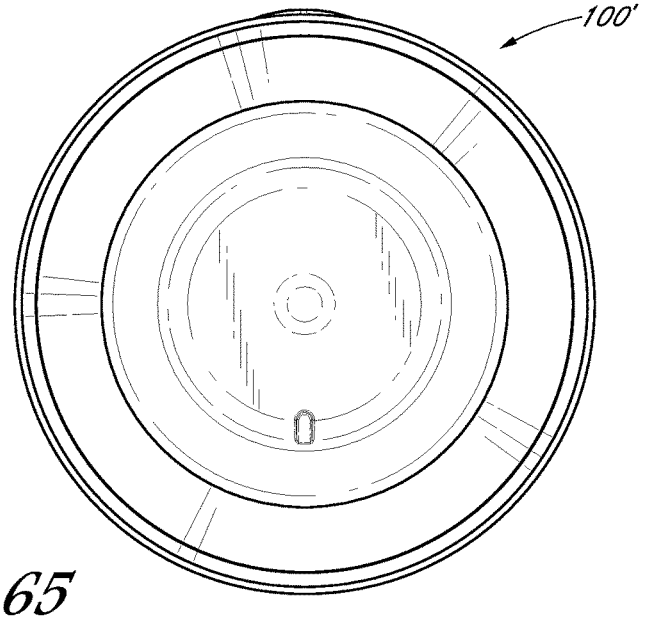
FIG. 65 is a bottom view of housing and lid shown in FIG. 61.
Figure 66:
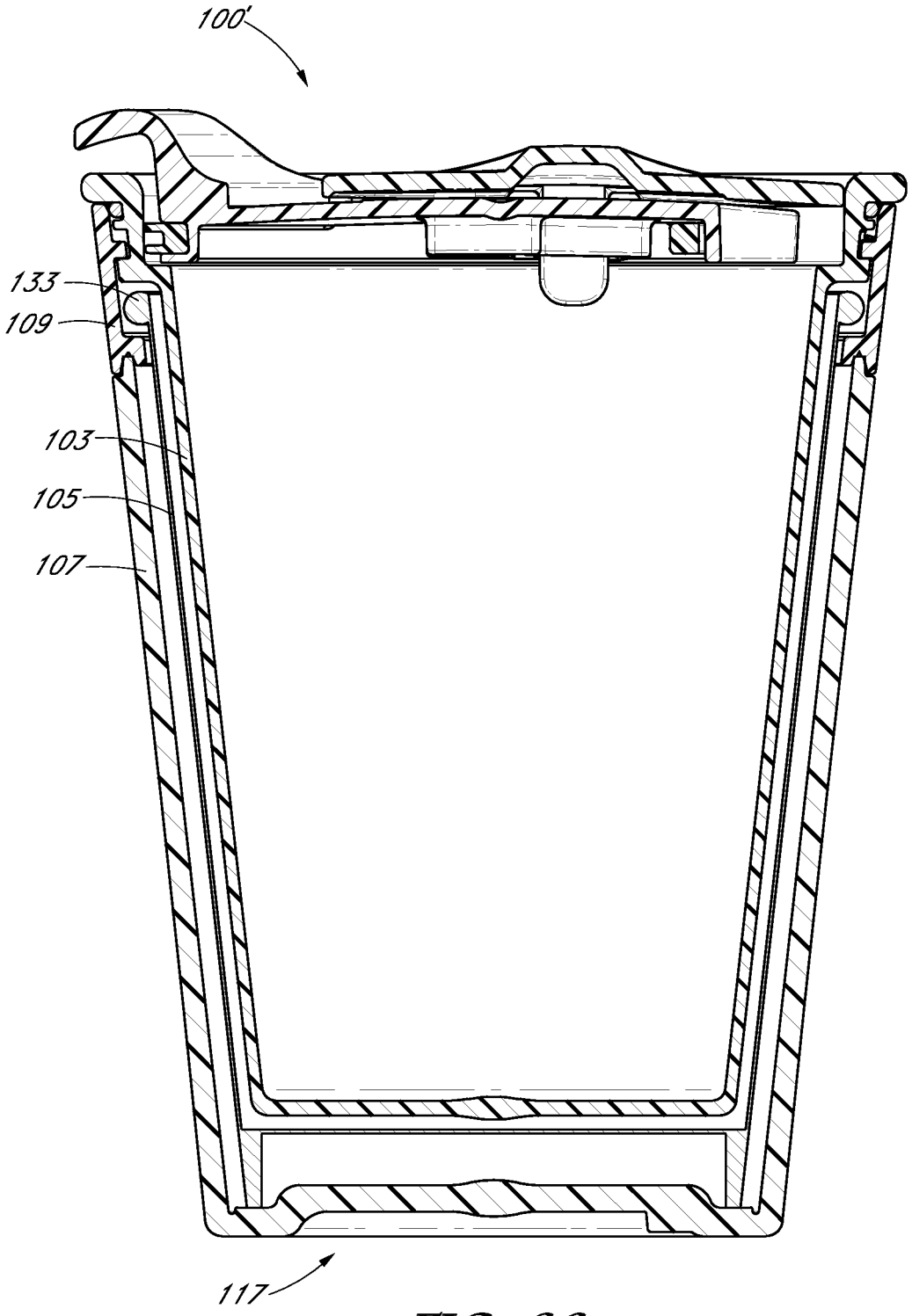
FIG. 66 is a cross-sectional view of the housing and lid shown in FIG. 61 as taken about the line 66-66 in FIG. 64.
Figure 68:
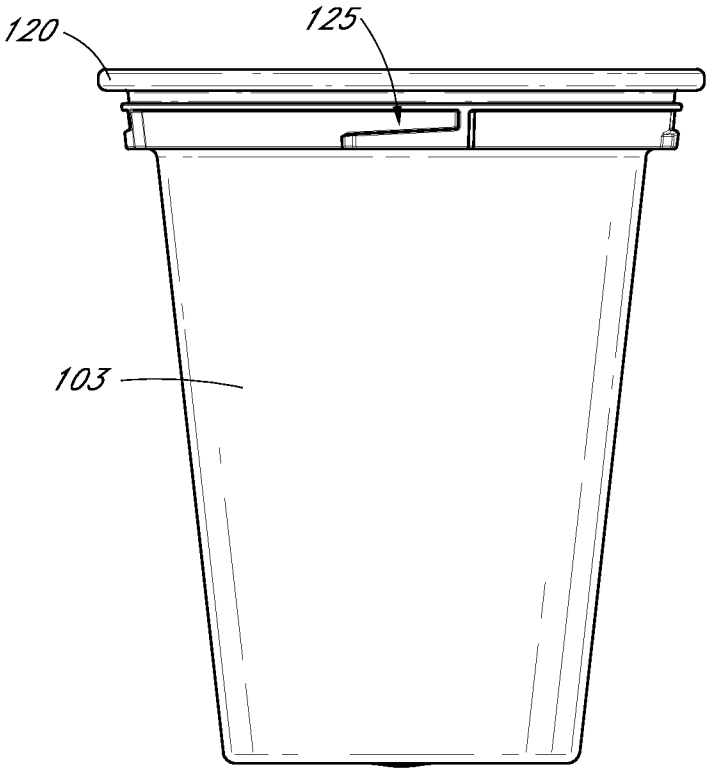
FIG. 68 is a side view of the inner shell of the housing of FIG. 61. The inner shell is similar to the inner shell illustrated in FIGS. 32-35.
Figure 67:
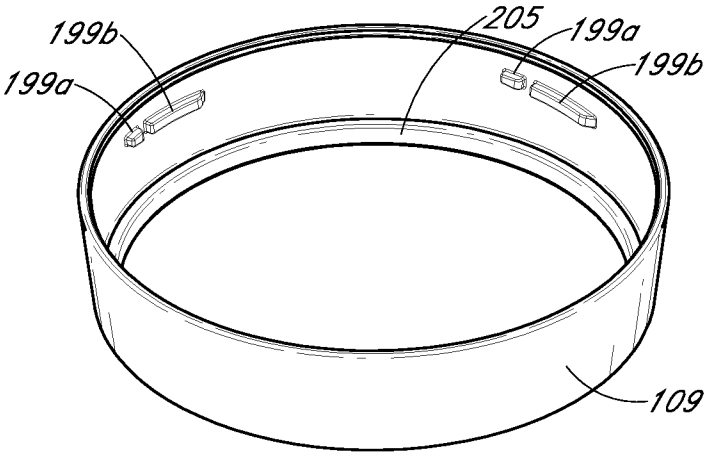
FIG. 67 is a perspective view of the coupling of the housing of FIG. 61. The coupling is similar to the coupling illustrated in FIGS. 24-27.

FIG. 41 provides an exploded view of the beverage container housing system 100 with the lid 801. As shown in FIG. 41, the lid 801 may include a seal 116, an O-ring 118, a body 114, and a sliding closure 113. As further shown in FIGS. 42-53, the sliding closure 113 may include two tabs 813 and the body 114 may include two openings 814. The tabs 813 may be placed into and removed from the larger width sections of the openings 814 and may slide back and forth through the elongated sections extending from the beverage opening to the rear of the body 114. The O-ring 118 and seal 116 are further detailed in FIGS. 54-60.

FIGS. 61-69 illustrate an example of a beverage housing system 100' according to a different embodiment. The embodiment of FIGS. 61-69 is substantially the same as the embodiments shown in FIGS. 1-38. However, the components of 100' have slight variations in appearance that will be appreciated by one of skill in the art.

The above description is provided to enable any person skilled in the art to make or use embodiments within the scope of the disclosed inventions. Various modifications to these aspects will be readily apparent to those skilled in the art, and the generic principles defined herein may be applied to other aspects without departing from the scope of the disclosure. Thus, the present disclosure is not intended to be limited to the aspects shown herein but is to be accorded the widest scope consistent with the principles and novel features disclosed herein.

Furthermore, the skilled artisan will recognize the interchangeability of various features from different embodiments. For example, the features disclosed in the various embodiments can be switched between embodiments. In addition to the variations described herein, other known equivalents for each feature can be mixed and matched by one of ordinary skill in this art to construct beverage container housing systems and techniques in accordance with principles of the present invention.

What is claimed is:

1. A beverage container system comprising:

an outer shell having a circular base and transparent walls extending to a circular rim;

a coupling ring having a bottom surface attached to the circular rim, a top surface, and at least one protrusion extending inwardly from an interior facing surface of the coupling ring; and an inner shell sized and shaped for insertion into the outer shell, the inner shell having a flange configured to rest on the top surface of the coupling ring and at least one receiving space configured to receive the at least one protrusion, wherein the inner shell and outer shell are sized and shaped to provide a space the receives a cup having a top rim having an outwardly extending flange between an exterior surface of the inner shell and an interior surface of the outer shell, wherein the coupling ring includes an inwardly extending lip located below the top surface of the coupling ring, the lip configured to support the outwardly extending flange from below.

2. The beverage container system of claim 1, further comprising the cup positioned in between the outer shell and the inner shell.

3. The beverage container system of claim 1, further comprising a removable lid that is couplable to the inner shell.

4. The beverage container system of claim 3, wherein the inner shell includes an inwardly extending lip, the lip configured to support a downward facing surface of the lid.

5. The beverage container system of claim 1, wherein the at least one protrusion is positioned into the at least one receiving space when the inner shell is rotated with respect to the outer shell.

6. The beverage container system of claim 1, wherein the coupling ring has at least four protrusions extending inward from the interior facing surface of the coupling ring.

7. The beverage container system of claim 6, wherein the at least four protrusions are spaced substantially equally apart about a circumference of the coupling ring.

8. A beverage container system comprising:

an outer shell having a circular base and transparent walls extending to a circular rim, wherein the base of the outer shell comprises a bottom end of the outer shell and the circular rim of the outer shell comprises a top end of the outer shell;

a coupling ring having a bottom surface attached to the circular rim, a top surface, and at least one protrusion extending inwardly from an interior facing surface of the coupling ring; and an inner shell sized and shaped for insertion into the outer shell, the inner shell having a flange configured to rest on the top surface of the coupling ring and at least one receiving space configured to receive the at least one protrusion, wherein the inner shell and outer shell are sized and shaped to provide a space that receives a cup between an exterior surface of the inner shell and an interior surface of the outer shell, wherein the inner shell comprises a bottom end and the flange of the inner shell comprises a top end of the inner shell.

9. The beverage container system of claim 8, wherein the coupling ring is positioned entirely in between the circular rim of the outer shell and the flange of the inner shell.

10. The beverage container system of claim 9, further comprising a removable lid that is couplable to the inner shell.

11. The beverage container system of claim 9, wherein the inner shell includes an inwardly extending lip, the lip configured to support a downward facing surface of the lid.

* * * * *